US011815848B2

(12) United States Patent
Ryuzaki et al.

(10) Patent No.: US 11,815,848 B2
(45) Date of Patent: Nov. 14, 2023

(54) IMAGE FORMING APPARATUS

(71) Applicant: FUJIFILM Business Innovation Corp., Tokyo (JP)

(72) Inventors: Teruyo Ryuzaki, Kanagawa (JP); Satoru Nishikawa, Kanagawa (JP); Yoshitaka Kuroda, Kanagawa (JP); Shinji Kawashima, Kanagawa (JP); Shinya Mitorida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 67 days.

(21) Appl. No.: 17/553,888

(22) Filed: Dec. 17, 2021

(65) Prior Publication Data

US 2023/0088654 A1 Mar. 23, 2023

(30) Foreign Application Priority Data

Aug. 25, 2021 (JP) ..... 2021-137599

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01); *G03G 15/2064* (2013.01)

(58) Field of Classification Search
CPC ..... G03G 21/206
See application file for complete search history.

(56) References Cited

U.S. PATENT DOCUMENTS

2014/0093269 A1* 4/2014 Hirasawa et al. .... G03G 21/206 399/92
2015/0153710 A1* 6/2015 Otsuka ..... H04N 1/00981 399/92
2017/0010568 A1* 1/2017 Kozuma ..... G03G 15/2028
2017/0010582 A1* 1/2017 Kojima et al. ..... G03G 21/206

FOREIGN PATENT DOCUMENTS

JP 3854214 B2 12/2006
JP 5769394 B2 8/2015
JP 2021-85971 A 6/2021

* cited by examiner

*Primary Examiner* — Sevan A Aydin
(74) *Attorney, Agent, or Firm* — Oliff PLC

(57) ABSTRACT

An image forming apparatus includes an image forming device that forms an image on a recording material, a forming device storage space storing the image forming device, a temperature adjustment space where a temperature adjustment device adjusts temperature, and a supply unit that supplies air in the temperature adjustment space into the forming device storage space.

18 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2021-137599 filed Aug. 25, 2021.

BACKGROUND

(I) Technical Field

The present disclosure relates to an image forming apparatus.

(II) Related Art

Japanese Patent No. 3854214 describes a configuration where a porous elastic roller that, after completion of development, absorbs and removes excess solvent remaining on a toner image formed on a photosensitive drum is provided downstream of each of image forming units around the photosensitive drum and a blower mechanism, which is a blowing apparatus that blows dry air onto the excess solvent remaining on the toner image, is provided.

Japanese Patent No. 5769394 describes an image forming apparatus including a cooling device that takes in outside air and that cools the outside air and air supply means for supplying the outside air that has been cooled by the cooling device into the image forming apparatus.

SUMMARY

When air whose temperature has been adjusted by a temperature adjustment mechanism is supplied to a forming device storage space storing an image forming device, for example, the temperature adjustment mechanism might directly supply air having an adjusted temperature to the forming device storage space.

A temperature adjustment device, however, often adjusts not only the temperature of air but also air volume. In this case, the amount of air supplied from the temperature adjustment device to a forming device storage space might decrease or increase due to the adjustment of air volume.

Aspects of non-limiting embodiments of the present disclosure relate to stabilization of the amount of air supplied to a forming device storage space at a time when air whose temperature has been adjusted by a temperature adjustment device is supplied to the forming device storage space.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image forming device that forms an image on a recording material, a forming device storage space storing the image forming device, a temperature adjustment space where a temperature adjustment device adjusts temperature, and a supply unit that supplies air in the temperature adjustment space into the forming device storage space.

BRIEF DESCRIPTION OF THE DRAWINGS

Exemplary embodiments of the present disclosure will be described in detail based on the following figures, wherein.

DETAILED DESCRIPTION

First Exemplary Embodiment

An exemplary embodiment of the present disclosure will be described in detail hereinafter with reference to the accompanying drawings.

Image Forming Apparatus

Figure 1:
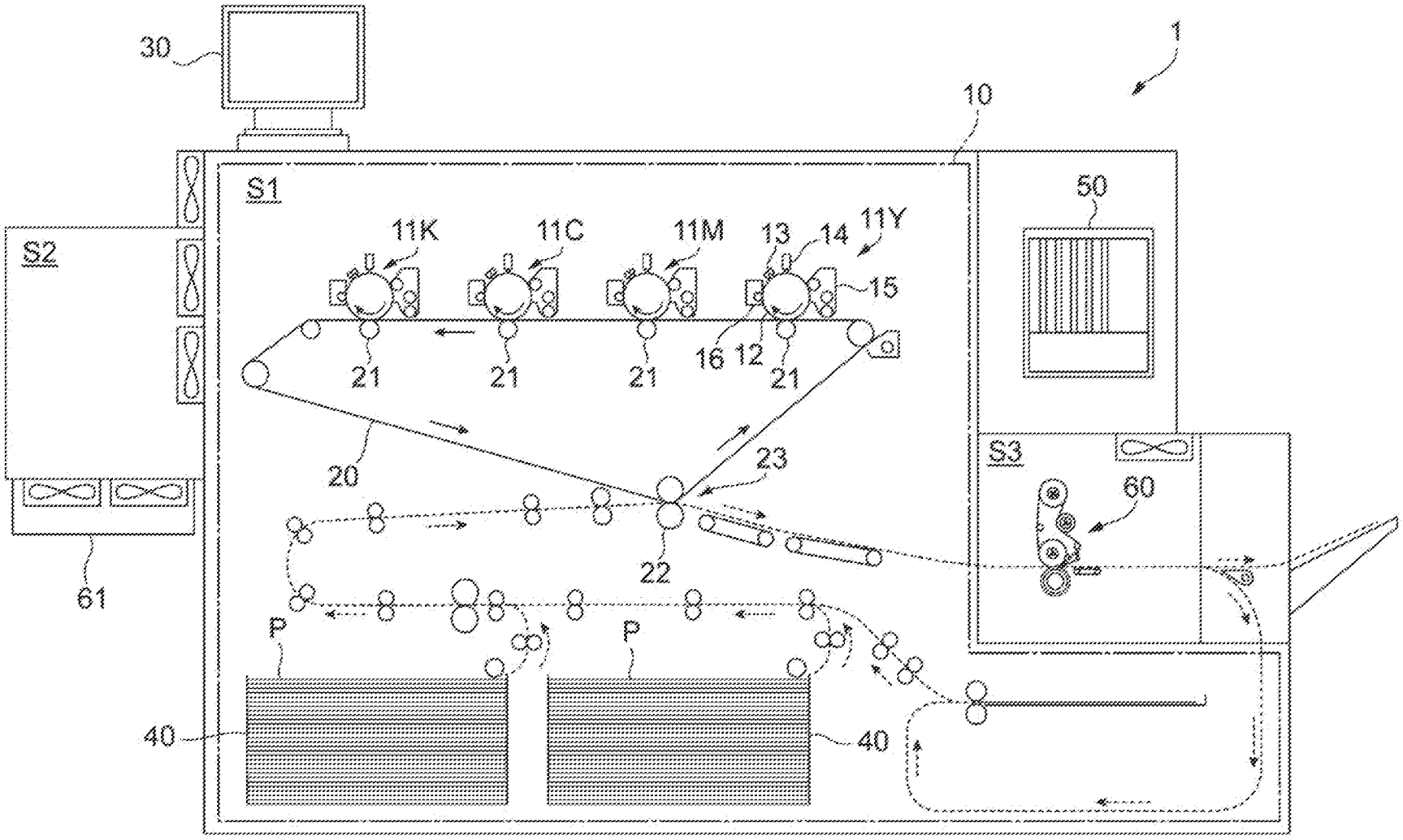
FIG. 1 is a schematic diagram illustrating the configuration of an image forming apparatus according to a first exemplary embodiment.

FIG. 1 is a schematic diagram illustrating the configuration of an image forming apparatus 1 according to a first exemplary embodiment.

The image forming apparatus 1 is a so-called "tandem" color printer and includes an image forming device 10 that forms, on the basis of image data, images on sheets of paper P as an example of a recording material, a control unit 50 that controls the operation of the entirety of the image forming apparatus 1, that communicates with personal computers and the like, and that performs image processing on image data, for example, and a user interface unit 30 that receives operations from a user and that displays various pieces of information for the user.

The image forming apparatus 1 according to the present exemplary embodiment also includes a temperature adjusting device 61 that adjusts the temperature of a space. The temperature adjusting device 61, may be, for example, an air conditioning device. The air conditioning device may be, for example, an air conditioner or a cooler.

The temperature adjusting device 61 includes a heat exchanger (not illustrated) and supplies, into the space, air that has passed through the heat exchanger and whose temperature has been adjusted in the heat exchanger. The air supplied into the space from the temperature adjusting device 61 adjusts the temperature of the space.

The temperature adjusting device 61 according to the present exemplary embodiment is also provided with a detection sensor (not illustrated) that detects the temperature of the space where the temperature adjusting device 61 is provided. The temperature adjusting device 61 supplies air with an air volume according to the temperature detected by the detection sensor. More specifically, the temperature adjusting device 61 sets an air volume on the basis of a temperature set by the user as a target temperature of the space and the temperature detected by the detection sensor and supplies air with the set air volume. A detection sensor that detects the temperature of the heat exchanger in the temperature adjusting device 61 may also be provided. The temperature adjusting device 61 may set an air volume on the basis of the temperature detected by the detection sensor and the temperature set by the user as the target temperature of the space and supply air with the set air volume.

Image Forming Device

The image forming device 10 is a function unit that forms images through, for example, electrophotography and includes four image forming units, namely an image forming unit 11Y for yellow (Y), an image forming unit 11M for magenta (M), an image forming nit 11C for cyan (C), and an image forming unit 11K for black (K).

The imageforming units will be generically referred to as "image forming units 11" in the following description when the image forming units are not distinguished from one another.

The image forming units 11 each include, for example, a photosensitive drum 12 on which a latent image is formed and then a toner image of a corresponding color is formed, a charger 13 that charges a surface of the photosensitive drum 12 with a predetermined potential, an exposing device 14 that exposes, on the basis of image data, the photosensitive drum 12 charged by the charger 13, a developer 15 that develops the latent image formed on the photosensitive drum 12 using toner of the corresponding color, and a cleaner 16 that cleans the surface of the photosensitive drum 12 after transfer. The image forming units 11 are configured in substantially the same manner except for a toner stored in the developer 15.

The image forming device 10 also includes a transfer belt 20 onto which toner images of the four colors formed on the photosensitive drums 12 of the image forming units 11 are transferred and a primary transfer roll 21 that transfers the toner images of the four colors formed by the image forming units 11 onto the transfer belt 20 (primary transfer). The image forming device 10 also includes a secondary transfer roll 22 that simultaneously transfers, onto one of the sheets of paper P in a superimposed manner, the toner images of the four colors transferred onto the transfer belt 20 (secondary transfer) and a fixing unit 60 that heats and pressurizes the sheet of paper P onto which the toner images of the four colors have been formed to heat-fix the toner images on the sheet of paper P. In the present exemplary embodiment, the fixing unit 60 functions as a fixing unit that fixes, on one of the sheets of paper P, an image formed by the image forming device 10 on the sheet of paper P.

In the present exemplary embodiment, an area where the secondary transfer roll 22 is provided and toner images of the four colors on the transfer belt 20 are subjected to the second transfer will be referred to as a "secondary transfer area 23".

Operation for Forming Image

Next, a basic operation for forming an image performed by the image forming apparatus 1 according to the present exemplary embodiment will be described.

The image forming units 11 of the image forming device 10 form toner images of yellow, magenta, cyan, and black, respectively, through an electrophotographic process using the above-described function members. The toner images of the four colors formed by the image forming units 11 are sequentially subjected to the primary transfer performed by the primary transfer roll 21 and transferred onto the transfer belt 20 to form a composite toner image, which are the toner images of the four colors superimposed upon one another. As the transfer belt 20 moves (in a direction indicated by arrows), the composite toner image on the transfer belt 20 is transported to the secondary transfer area 23 where the secondary transfer roll 22 is provided.

In a paper transport system, a sheet of paper P fed from a sheet container 40 by a feed roller is transported along a transport path and reaches the secondary transfer area 23. In the secondary transfer area 23, a composite toner image on the transfer belt 20 is subjected to the secondary transfer and transferred onto the sheet of paper P by the action of a transfer field generated by the secondary transfer roll 22.

The sheet of paper P on which an image has been formed is removed from the transfer belt 20 and transported to the fixing unit 60 along the transport path. The image on the sheet of paper P transported to the fixing unit 60 is fixed by the fixing unit 60 on the sheet of paper P.

In the case of double-sided printing, a fixed image is formed on a first surface of a sheet of paper P through the above-described process, and the sheet of paper P is turned over along the transport path and reaches the secondary transfer area 23 again. In the secondary transfer area 23, as in the case of the first surface, toner images of the four colors on the transfer belt 20 are simultaneously subjected to the secondary transfer and transferred onto a second surface of the sheet of paper P by the action of the transfer field generated by the secondary transfer roll 22. The fixing unit 60 then, as in the case of the first surface, fixes the toner images, and a fixed image is formed on the second surface.

The control unit 50 controls the above-described operation for forming an image. In the present exemplary embodiment, the control of the operation for forming an image and the control of the adjustment of the temperature of the space are separately performed by the control unit 50 and the temperature adjusting device 61, respectively. That is, the temperature adjusting device 61 controls the adjustment of the temperature of the space independently of the control of the operation for forming an image.

Spaces

Next, spaces provided in the image forming apparatus 1 will be described.

The image forming apparatus 1 according to the present exemplary embodiment is provided with a forming device storage space S1, a temperature adjustment space S2, and a fixing unit storage space S3.

The forming devicestorage space S1 is a space storing the image forming device 10. The sheet container 40 may be provided outside the forming device storage space S1, instead.

The temperature adjustment space S2 is a space where the temperature adjusting device 61 adjusts temperature. The temperature adjusting device 61 is connected to the temperature adjustment space S2. Air supplied to the temperature adjustment space S2 from the temperature adjusting device 61 adjusts the temperature of the temperature adjustment space S2. The temperature adjusting device 61 may be provided inside the temperature adjustment space S2, instead.

The fixing unit storage space S3 is a space storing the fixing unit 60. In the present exemplary embodiment, heat generated by the fixing unit 60 to fix a composite image on a sheet of paper P increases the temperature of the fixing unit storage space S3. More specifically, the temperature of the fixing unit storage space S3 during the operation for forming an image is higher than that inside the forming device storage space S1.

The temperature adjustment space S2 is connected to the forming device storage space S1. The fixing unit storage space S3 is also connected to the forming device storage space S1. A separation member (not illustrated) that at least partially separates the forming device storage space S1. and the temperature adjustment space S2 from each other is provided at a boundary between the forming device storage space S1 and the temperature adjustment space S2. A separation member (not illustrated) that at least partially separates the forming device storage space S1 and the fixing unit storage space S3 from each other is provided at a boundary between the forming device storage space S1 and the fixing unit storage space S3. These separation members may be, for example, walls. The separation members may include a heat insulating material.

In the present exemplary embodiment, the temperature of the forming device storage space S1 is adjusted by supplying air into the forming device storage space S1. In the present exemplary embodiment, air in the forming device storage space S1. is discharged from the forming device storage space S1. to reduce contamination inside the forming device storage space S1. A mechanism for supplying air into the forming device storage space S1 and a mechanism for discharging air from the forming device storage space S1 will be described in detail hereinafter.

Mechanisms for Supplying and Discharging Air

Next, the mechanisms for supplying and discharging air into and from the spaces inside the image forming apparatus 1 will be described.

Figure 2:
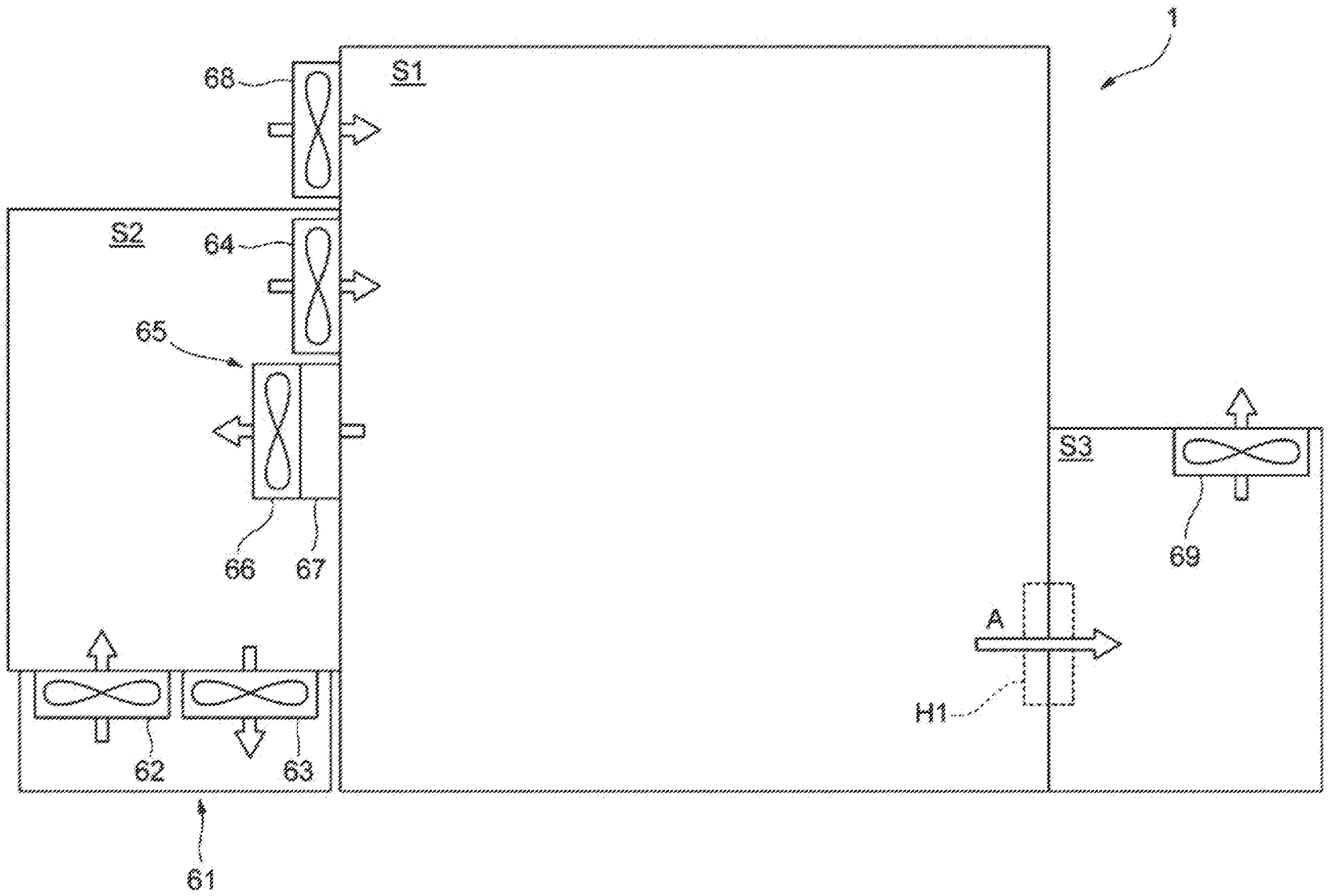
FIG. 2 is a diagram illustrating mechanisms for supplying and discharging air into and from spaces inside the image forming apparatus.

FIG. 2 is a diagram illustrating the mechanisms for supplying and discharging air into and from the spaces inside the image forming apparatus 1. In FIG. 2, the image forming device 10 and the fixing unit 60 are omitted.

The temperature adjusting device 61 illustrated in FIG. 2 is provided with a device air supply fan 62 and a device air discharge fan 63. The device air supply fan 62 and the device air discharge fan 63 are provided inside the temperature adjusting device 61.

The device air supply fan 62 sends air in the temperature adjusting device 61 to the temperature adjustment space S2.

The device air discharge fan 63 sends air in the temperature adjustment space S2 to the temperature adjusting device 61.

An adjustment space air supply fan 64 and a forming device space air discharge device 65 are provided inside the temperature adjustment space S2

The adjustment space air supply fan 64, which is an example of a supply unit, sends air in the temperature adjustment space S2 into the forming device storage space S1.

The forming device space air discharge device 65, which is another example of the supply unit, discharges air in the forming device storage space S1 to the temperature adjustment space S2. The forming device space air discharge device 65 includes a forming device space air discharge fan 66 and a discharge filter 67.

The forming device space air discharge fan 66 sends air in the forming device storage space S1 into the temperature adjustment space S2.

The discharge filter 67 separates an airflow caused by the forming device space air discharge fan 66 and substances contained in the airflow. The substances contained in the airflow include, for example, ozone and a toner cloud. A toner cloud is toner floating in the air. In the present exemplary embodiment, the charging performed by the charger 13 can generate ozone. The development performed by the developer 15 can generate a toner cloud. The discharge filter 67 passes air to be sent to the forming device space air discharge fan 66 and collects ozone and a toner cloud floating in the air.

The adjustment space air supply fan 64 may be provided inside the forming device storage space S1, instead, insofar as the adjustment space air supply fan 64 supplies air in the temperature adjustment space S2 into the forming device storage space S1. The forming device space air discharge device 65 may be provided inside the forming device storage space S1, instead, insofar as the forming device space air discharge device 65 supplies air in the forming device storage space S1 into the temperature adjustment space S2.

Figure 4:
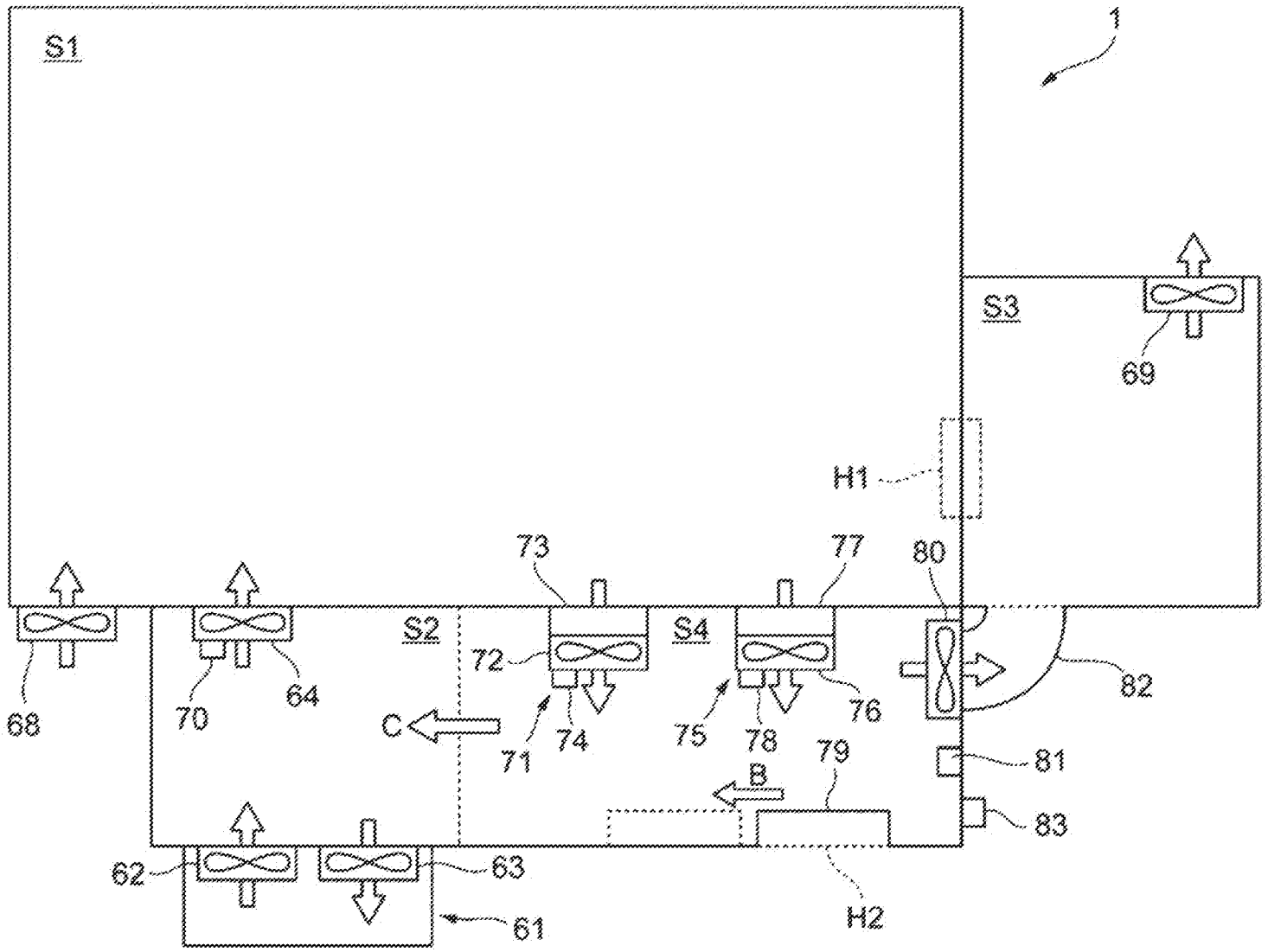
FIG. 4 is a diagram illustrating a modification.

The adjustment space air supply fan 64 and the forming device space air discharge device 65 may be integrated together, instead. Alternatively, the adjustment space air supply fan 64 and the forming device space air discharge device 65 may be provided separately from the forming device storage space S1 and the temperature adjustment space S2 in a partitioned space connected to the forming device storage space S1 and the temperature adjustment space S2 as illustrated in FIG. 4 or in a duct-shaped passage that connects the forming device storage space S1 and the temperature adjustment space S2 to each other to send air.

The image forming apparatus 1 is also provided with an outside air supply fan 68, which is an example of an outside air supply unit. The outside air supply fan 68 is connected to the forming device storage space S1. The outside air supply fan 68 sends air outside the image forming apparatus 1 into the forming device storage space S1.

The outside air supply fan 68 may be provided inside the forming device storage space S1, instead, insofar as the outside air supply fan 68 supplies air outside the image forming apparatus 1 into the forming device storage space S1.

The fixing unit storage space S3 is provided with a fixing unit space air discharge fan 69. The fixing unit space air discharge fan 69 sends air in the fixing unit storage space S3 to the outside of the image forming apparatus 1.

A transport opening area H1 including an openingis provided at a connection between the forming device storage space S1 and the fixing unit storage space S3. An image is formed on a sheet of paper P in the image forming device 10 (refer to FIG. 1) provided inside the forming device storage space S1, and the sheet of paper P passes through the transport opening area H1 and reaches the fixing unit storage space S3.

Effects of Fans

Next, effects of the fans and the like provided for the image forming apparatus 1 will be described.

When the temperature adjustment space S2 is cooled, for example, the device air supply fan 62 of the temperature-adjusting device 61 supplies, to the temperature adjustment space S2, cold air based on a temperature set by the temperature adjusting device 61 as a target temperature of the temperature adjustment space S2. The device air discharge fan 63 discharges air in the temperature adjustment space S2 to the temperature adjusting device 61. As a result of the supply of cold air performed by the device air supply fan 62 and the discharge of air performed by the device air discharge fan 63, air in the temperature adjustment space S2 and air in the temperature adjusting device 61 change places, and the temperature adjustment space S2 is cooled.

In the present exemplary embodiment, air having an adjusted temperature is supplied into the forming device storage space S1.

A mode is possible, for example, in which the temperature adjusting device 61 is connected to the forming device storage space S1 and the temperature adjusting device 61 directly supplies air having an adjusted temperature into the forming device storage space S1. In this case, however, air volume of the device air supply fan 62 in the temperature adjusting device 61 varies as the temperature of the forming device storage space S1 changes. The amount of air supplied into the forming device storage space S1 from the temperature adjusting device 61, therefore, might decrease or increase.

In the present exemplary embodiment, on the other hand, the adjustment space air supply fan 64 supplies air in the temperature adjustment space S2 into the forming device storage space S1. More specifically, the adjustment space air supply fan 64 supplies air in the temperature adjustment space S2 whose temperature has been adjusted by the temperature adjusting device 61 into the forming device storage space S1.

In this case, the adjustment space air supply fan 64 supplies air into the forming device storage space S1 with a predetermined air volume.

In particular, in the present exemplary embodiment, the adjustment space air supply fan 64, which is a blower, is used to supply air in the temperature adjustment space S2 into the forming device storage space S1. In addition, the temperature adjusting device 61 includes the device air supply fan 62, which is a blower that sends air having an adjusted temperature into the temperature adjustment space S2. That is, the adjustment space air supply fan 64 is a blower different from the device air supply fan 62, which is a blower included in the temperature adjusting device 61.

In addition, in the present exemplary embodiment, air in the forming device storage space S1. and air outside the forming device storage space S1 change places as a result of the supply of air into the forming device storage space S1 and the discharge of air from the forming device storage space S1.

Figure 3:
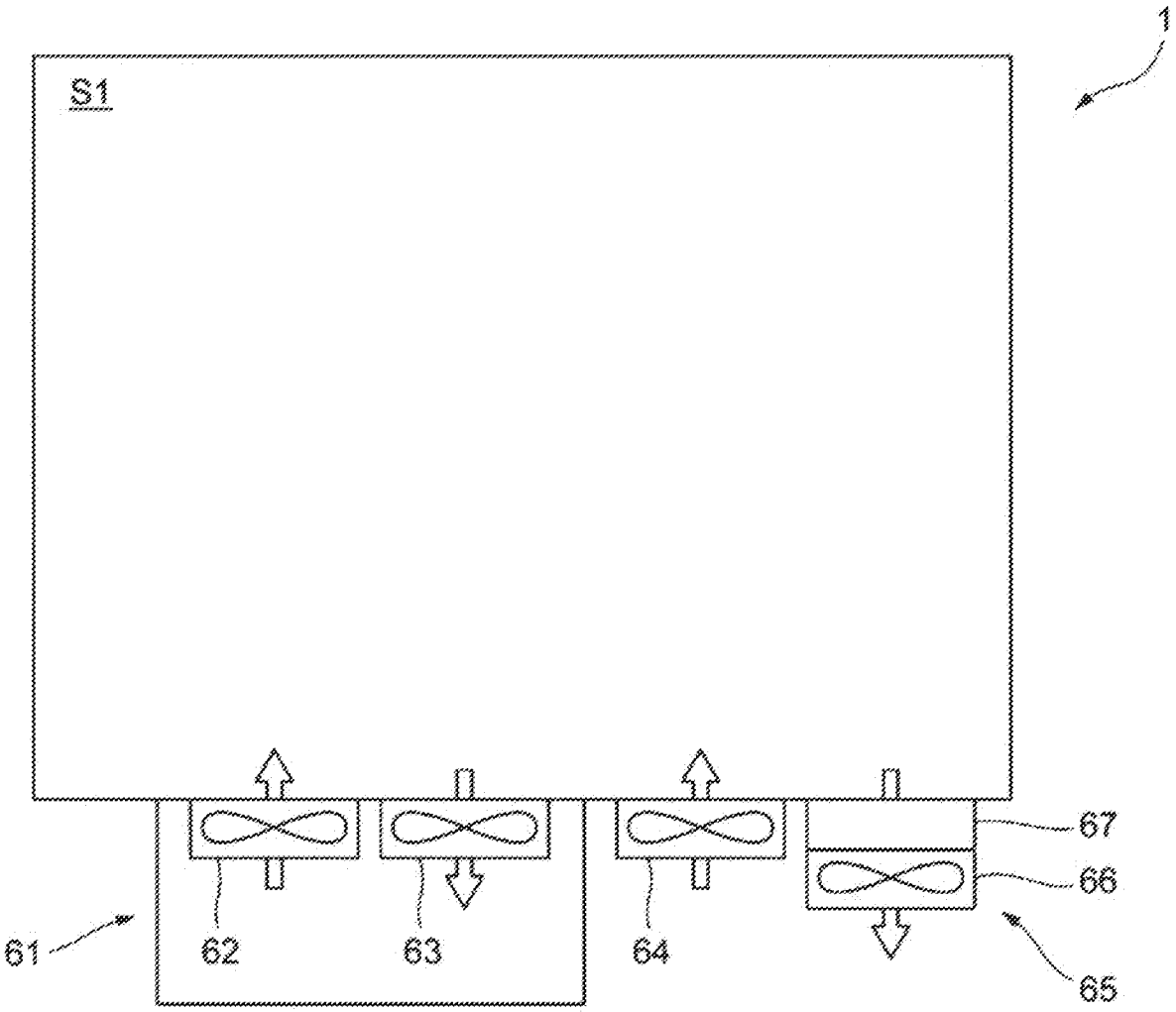
FIG. 3 is a diagram illustrating a comparative example.

FIG. 3 is a diagram illustrating a comparative example.

In the comparative example, the temperature adjusting device 61 directly supplies air having an adjusted temperature into the forming device storage space S1. The adjustment space air supply fan 64 also supplies air outside the image forming apparatus 1 into the forming device storage space S1. Furthermore, the forming device space air discharge device 65 discharges air in the forming device storage space S1 to the outside of the image forming apparatus 1.

In this case, air outside the image forming apparatus 1, that is, air whose temperature has not been adjusted, is supplied to the forming device storage space S1 along with the air whose temperature has been adjusted by the temperature adjusting device 61.

In the present exemplary embodiment, on the other hand, the adjustment space air supply fan 64 supplies air in the temperature adjustment space S2 into the forming device storage space S1, and the forming device space air discharge device 65 supplies air in the forming device storage space S1 into the temperature adjustment space S2 as illustrated in FIG. 2. In this case, air outside the image forming apparatus 1 need not be used in order to replace air in the forming device storage space S1 and air outside the forming device storage space S1 with each other. Air volume of the adjustment space air supply fan 64 and air volume of the forming device space air discharge fan 66 may be the same in this case.

The outside air supply fan 68 supplies air outside the image forming apparatus 1 into the forming device storage space S1. In this case, pressure inside the forming device storage space S1 increases. In the present exemplary embodiment, the outside air supply fan 68 makes the pressure inside the forming device storage space S1 higher than pressure inside the fixing unit storage space S3 by supplying air outside the image forming apparatus 1 into the forming device storage space S1. In this case, air in the forming device storage space S1 flows in a direction indicated by arrow A in FIG. 2, that is, from the forming device storage space S1 to the fixing unit storage space S3, and enters the fixing unit storage space S3 through the opening in the transport opening area H1. Because of this airflow, hot air in the fixing unit storage space S3 hardly enters the forming device storage space S1.

With the configuration illustrated in FIG. 2, the amount of outside air supplied by the outside air supply fan 68 to make the pressure inside the forming device storage space S1 higher than that inside the fixing unit storage space S3 is reduced by the amount of air having an adjusted temperature supplied by the adjustment space air supply fan 64 into the forming device storage space S1. Compared to the comparative example illustrated in FIG. 3, therefore, a decrease in the efficiency of adjusting the temperature of the forming device storage space S1 is suppressed.

As described above, the temperature of the fixing unit storage space S3 is high in the present exemplary embodiment. When air containing ozone generated in the forming device storage space S1 flows into the fixing unit storage space S3, therefore, the ozone in the air is thermally decomposed. The air that has flowed into the fixing unit storage space S3 is discharged from the image forming apparatus 1 by the fixing unit space air discharge fan 69.

The outside air supply fan 68 also functions as a pressurization unit that makes the pressure inside the forming device storage space S1 higher than that inside the fixing unit storage space S3.

Here, the pressure inside the forming device storage space S1 may be increased, for example, by increasing the amount of air supplied into the forming device storage space S1 from the temperature adjustment space S2 or restricting the discharge of air from the forming device storage space S1. When the outside air supply fan 68 supplies air outside the image forming apparatus 1 into the forming device storage space S1 as in the present exemplary embodiment, on the other hand, the concentration of ozone or substances such as a toner cloud in the air in the forming device storage space S1 decreases since outside air flows into the forming device storage space S1.

In the present exemplary embodiment, however, a mechanism for increasing the amount of air supplied into the forming device storage space S1 from the temperature adjustment space S2 or restriction means for restricting the discharge of air from the forming device storage space S1 may be provided, instead, in order to increase the pressure inside the forming device storage space S1. In this case, the mechanism for increasing the amount of air supplied into the forming device storage space S1 from the temperature adjustment space S2 or the restriction means functions as a pressurization unit that makes the pressure inside the forming device storage space S1 higher than that inside the fixing unit storage space S3.

The outside air supply fan 68 may supply air to a part of the forming device storage space S1 where the concentration of ozone or substances such as a toner cloud in the air may be low. The part of the forming device storage space S1 where the concentration of ozone or substances such as a toner cloud in the air may be low may be, for example, an area where the charger 13 performs charging or a surrounding area thereof.

In addition, the outside air supply fan 68 may supply air outside the image forming apparatus 1 into the forming device storage space S1 if, for example, a predetermined condition is satisfied. For example, a first pressure detection sensor that detects the pressure inside the forming device storage space S1 and a second pressure detection sensor that detects the pressure inside the fixing unit storage space S3 may be provided, and if the pressure detected in the forming device storage space S1 is lower than that detected in the fixing unit storage space S3, the outside air supply fan 68 may be operated. Alternatively, for example, a sensor that detects the concentration of ozone or substances such as a toner cloud in the air may be provided for the forming device storage space S1, and if the concentration of ozone or substances such as a toner cloud is higher than a predetermined value, the outside air supply fan 68 may be operated. A condition that the pressure inside the forming device storage space S1 be lower than that inside the fixing unit storage space S3 or a condition that the concentration of ozone or substances such as a toner cloud in the air be higher than the predetermined value may be the predetermined condition.

Modification

Next, mechanisms for supplying and discharging air into and from the spaces inside the image forming apparatus 1 according to a modification will be described.

FIG. 4 is a diagram illustrating the mechanisms for supplying and discharging air into and from the spaces inside the image forming apparatus 1 according to the present modification. In the present modification, the same components as those described above are given the same reference numerals. In the present modification, the temperature adjustment space S2, the temperature adjusting device 61, and the outside air supply fan 68 are provided at positions different from those illustrated in FIG. 2 for convenience of description, but the temperature adjustment space S2, the temperature adjusting device 61, and the outside air supply fan 68 may be provided at the same positions as in FIG. 2.

In the present modification, the adjustment space air supply fan 64 and a supply detection sensor 70 are provided in the temperature adjustment space S2.

The supply detection sensor 70 detects the amount of air supplied by the adjustment space air supply fan 64 in unit time. For example, the supply detection sensor 70 detects rotational speed of a motor of the adjustment space air supply fan 64 in operation and calculates the amount of air supplied by the adjustment space air supply fan 64 in unit time on the basis of the detected rotational speed.

The temperature adjusting device 61 is connected to the temperature adjustment space S2.

In the present modification, a connection space S4 connected to the forming device storage space S1 and the temperature adjustment space S2 are provided for the image forming apparatus 1. A separation member (not illustrated) that at least partially separates the forming device storage space S1 and the connection space S4 from each other is provided at a boundary between the forming device storage space S1 and the connection space S4. The temperature adjustment space S2 and the connection space S4, on the other hand, are not separated from each other. A separation member, however, may also be provided at a boundary between the temperature adjustment space S2 and the connection space S4.

In the connection space S4, a first air discharge device 71, a first discharge amount detection sensor 74, a second air discharge device 75, a second discharge amount detection sensor 78, a shutter 79, a connection space air discharge fan 80, and a cloud concentration detection sensor 81 are provided.

A connection pipe 82 connecting the connection space S4 and the fixing unit storage space S3 to each other is also provided for the image forming apparatus 1. Furthermore, an outside temperature detection sensor 83 is provided for the image forming apparatus 1.

The first air discharge device 71 discharges air in the forming device storage space S1 to the connection space S4. The first air discharge device 71A includes a first air discharge fan 72 and a cloud filter 73.

The first air discharge fan 72 sends air in the forming device storage space S1 into the connection space S4.

The cloud filter 73 collects a toner cloud in an airflow caused by the first air discharge device 71. For example, openings of the cloud filter 73 are smaller than particles of toner in the developer 15.

The first discharge amount detection sensor 74 detects the amount of air discharged by the first air discharge fan 72 in unit time. For example, the first discharge amount detection sensor 74 detects rotational speed of a motor of the first air discharge fan 72 in operation and calculates the amount of air discharged by the first air discharge fan 72 in unit time on the basis of the detected rotational speed.

The second air discharge device 75 discharges air in the forming device storage space S1 to the connection space S4. The second air discharge device 75 includes a second discharge fan 76 and an ozone filter 77.

The second discharge fan 76 sends air in the forming device storage space S1 into the connection space S4. Air sent by the first air discharge fan 72 and the second discharge fan 76 flows in a direction indicated by arrow C in FIG. 4, that is, from the connection space S4 to the temperature adjustment space S2.

The ozone filter 77 collects ozone in an airflow caused by the second discharge fan 76. The ozone filter 77A includes a catalyst (not illustrated), which decomposes ozone into oxygen.

The second discharge amount detection sensor 78 detects the amount of air discharged by the second discharge fan 76 in unit time. The second discharge amount detection sensor 78 detects rotational speed of a motor of the second discharge fan 76 in operation and calculates the amount of air discharged by the second discharge fan 76 in unit time on the basis of the detected rotational speed.

The shutter 79, which is an example of a pressure adjustment unit, opens and closes the connection space S4 to the outside of the image forming apparatus 1. An external opening area H2 including an opening connecting to the outside of the image forming apparatus 1 is provided for the connection space S4, and the shutter 79 covers the external opening area H2. The connection space S4 is thus closed to the outside of the image forming apparatus 1. The shutter 79 is provided movably in a direction indicated by arrow B in FIG. 4. When the shutter 79 moves in the direction indicated by arrow B, the connection space S4 opens to the outside of the image forming apparatus 1 through the opening in the external opening area H2.

The amount of movement in the direction indicated by arrow B can be adjusted stepwise, and the area of the opening in the connection space S4 to the outside of the image forming apparatus 1 is determined on the basis of the amount of movement of the shutter 79. In the present exemplary embodiment, a degree of opening of the connection space S4 to the outside of the image forming apparatus 1 can be set to "1", "2", or "3" by adjusting the amount of movement of the shutter 79. As the degree of opening of the connection space S4 to the outside of the image forming apparatus 1 becomes higher, the area of the opening in the connection space S4 to the outside of the image forming apparatus 1 becomes larger. The amount of movement of the shutter 79 may be adjusted such that the number of degrees of opening of the connection space S4 to the outside of the image forming apparatus 1 becomes two or less or four or more, instead.

As the degree of opening of the connection space S4 to the outside of the image forming apparatus 1 becomes higher, the amount of air that can flow in and out of the connection space S4 becomes larger in the present exemplary embodiment.

The connection space air discharge fan 80 sends air out of the connection space S4. Air sent to the connection space air discharge fan 80 is discharged to the fixing unit storage space S3 through the connection pipe 82.

The cloud concentration detection sensor 81 detects the concentration of a toner cloud in air in the connection space S4 in unit volume.

The outside temperature detection sensor 83 detects the temperature of the outside of the image forming apparatus 1. The outside temperature detection sensor 83 is mounted on an outer surface of a case of the image forming apparatus 1.

Airflows When Pressure Inside Temperature Adjustment Space and Connection Space is Low Next, airflows at a time when the pressure inside the temperature adjustment space S2 and the connection space S4 is low will be described.

Figure 5:
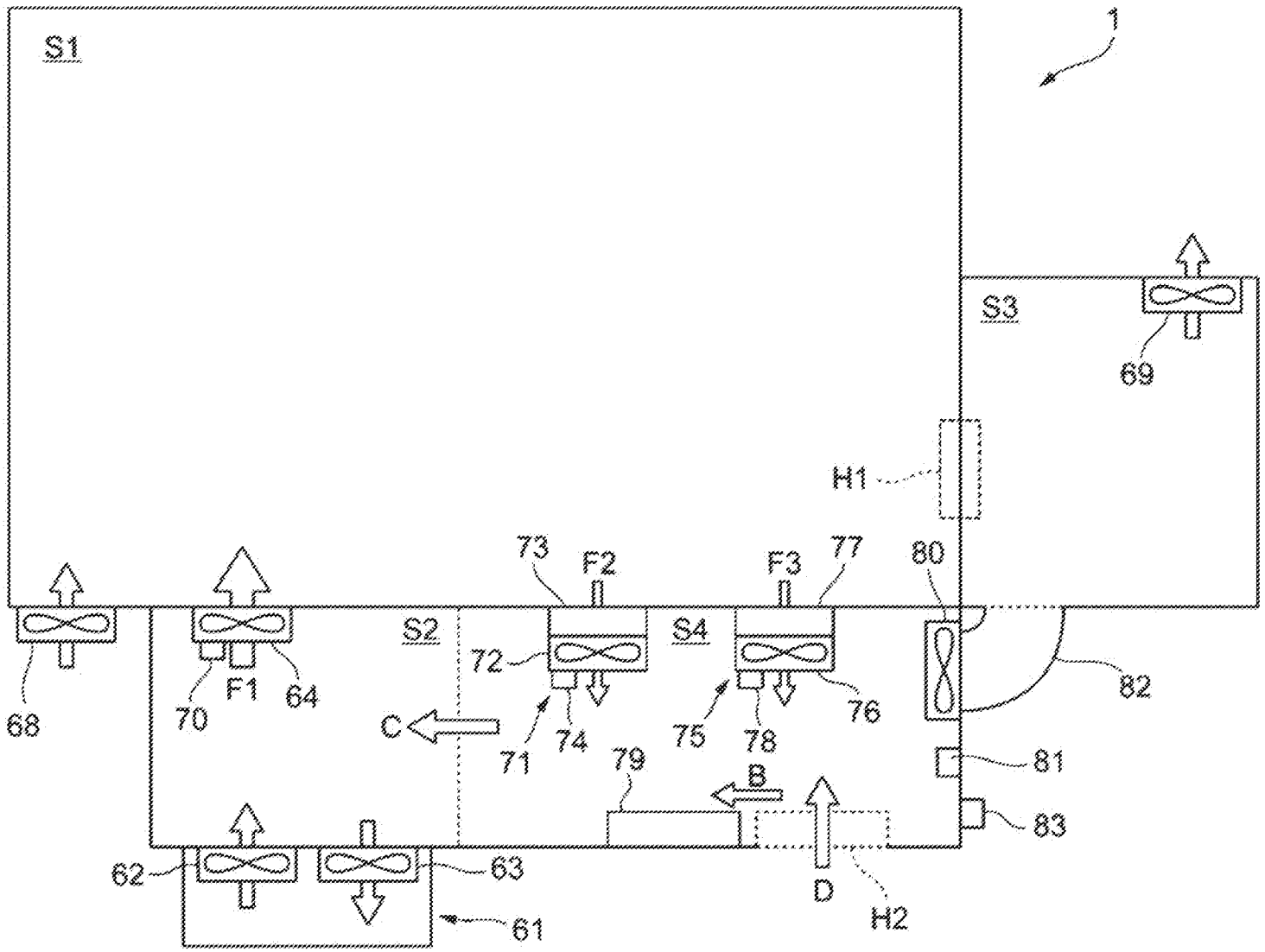
FIG. 5 is a diagram illustrating airflows at a time when pressure inside a temperature adjustment space and a connection space is low.

FIG. 5 is a diagram illustrating the airflows at the time when the pressure inside the temperature adjustment space S2 and the connection space S4 is low.

In the present exemplary embodiment, the adjustment space air supply fan 64 supplies air from the temperature adjustment space S2 into the forming device storage space S1. The first air discharge fan 72 and the second discharge fan 76 discharge air from the temperature adjustment space S2 to the connection space S4.

The amount of air supplied by the adjustment space air supply fan 64 from the temperature adjustment space S2 into the forming device storage space S1 in unit time will be referred to as a "supply F1" hereinafter. The amount of air discharged by the first air discharge fan 72 from the forming device storage space S1 to the connection space S4 in unit time will be referred to as a "discharge F2" hereinafter. The amount of air discharged by the second discharge fan 76 from the forming device storage space S1 to the connection space S4 will be referred to as a "discharge F3" hereinafter.

The supply detection sensor 70 may calculate the supply F1. The first discharge amount detection sensor 74 may calculate the discharge F2. The second discharge amount detection sensor 78 may calculate the discharge F3.

The sum of the discharge F2 and the discharge F3 might be smaller than the supply F1. In other words, the amount of air supplied from the temperature adjustment space S2 and the connection space S4 into the forming device storage space S1 might be larger than the amount of air supplied from the forming device storage space S1 to the temperature adjustment space S2 and the connection space S4. In this case, the pressure inside the temperature adjustment space S2 and the connection space S4 might be lower than that inside the forming device storage space S1 or that of the outside of the image forming apparatus 1.

If the shutter 79 is moved in the direction indicated by arrow B in FIG. 5 in this case, outside air begins to flow in a direction indicated by arrow D in FIG. 5, that is, from the outside of the image forming apparatus 1 to the connection space S4. As a result, the pressure inside the connection space S4 and the temperature adjustment space S2 increases.

Airflows When Pressure Inside Temperature Adjustment Space and Connection Space is High Next, airflows at a time when the pressure inside the temperature adjustment space S2 and the connection space S4 is high will be described.

Figure 6:
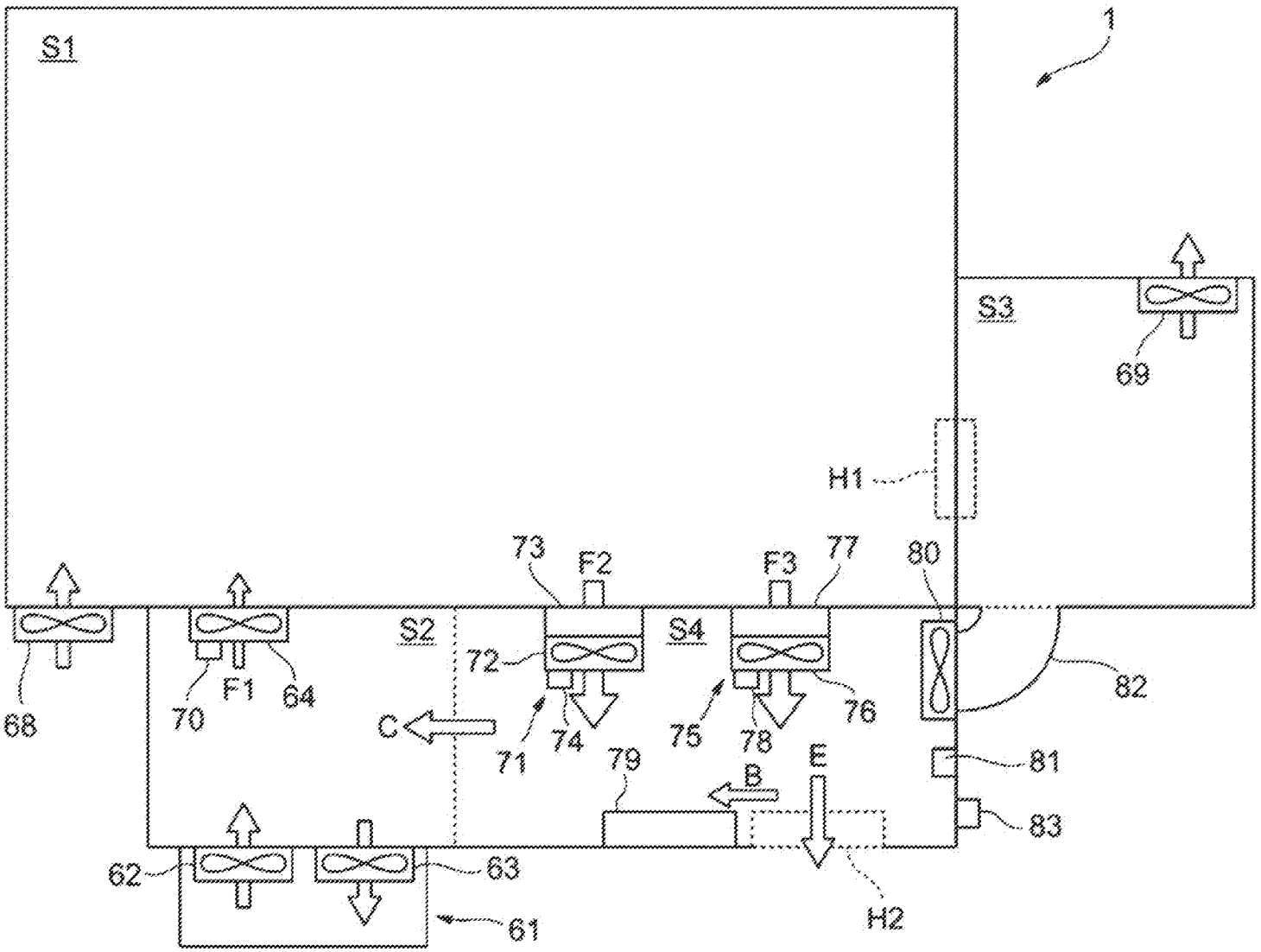
FIG. 6 is a diagram illustrating airflows at a time when the pressure inside the temperature adjustment space and the connection space is high.

FIG. 6 is a diagram illustrating the airflows at a time when the pressure inside the temperature adjustment space S2 and the connection space S4 is high.

The sum of the discharge F2 and the discharge F3 might be larger than the supply F1. In other words, the amount of air supplied from the forming device storage space S1 to the temperature adjustment space S2 and the connection space S4 might be larger than the amount of air supplied from the temperature adjustment space S2 and the connection space S4 to the forming device storage space S1. In this case, the pressure inside the temperature adjustment space S2 and the connection space S4 might be higher than that inside the forming device storage space S1 or that of the outside of the image forming apparatus 1.

If the shutter 79 is moved in the direction indicated by arrow B in FIG. 6 in this case, air in the connection space S4 begins to flow in a direction indicated by arrow E in FIG. 6, that is, from the connection space S4 to the outside of the image forming apparatus 1. As a result, the pressure inside the connection space S4 and the temperature adjustment space S2 decreases.

As described above, the shutter 79 and the external opening area H2 adjust the pressure inside the temperature adjustment space S2 in the present exemplary embodiment. More specifically, the shutter 79 and the external opening area H2 adjust the area of the opening provided for the connection space 34 to adjust the pressure inside the temperature adjustment space S2. In this case, the shutter 79 and the external opening area H2 function as a pressure adjustment unit.

In the present exemplary embodiment, the image forming apparatus 1 includes the connection pipe 82, which is a channel that allows air in the connection space S4 to flow toward the fixing unit storage space S3.

In the connection space S4, air that has been discharged by the first air discharge device 71 or the second air discharge device 75 from the forming device storage space S1 and that contains ozone which has not been collected by the ozone filter 77 might exist. This air reaches the fixing unit storage space S3 through the connection pipe 82. The ozone in the air is thermally decomposed in the fixing unit storage space S3.

Process for Controlling Shutter

Next, a process for controlling the shutter 79 will be described. The process for controlling the shutter 79 is a process for controlling movement of the shutter 79. The control unit 50 performs this process.

Figure 7:
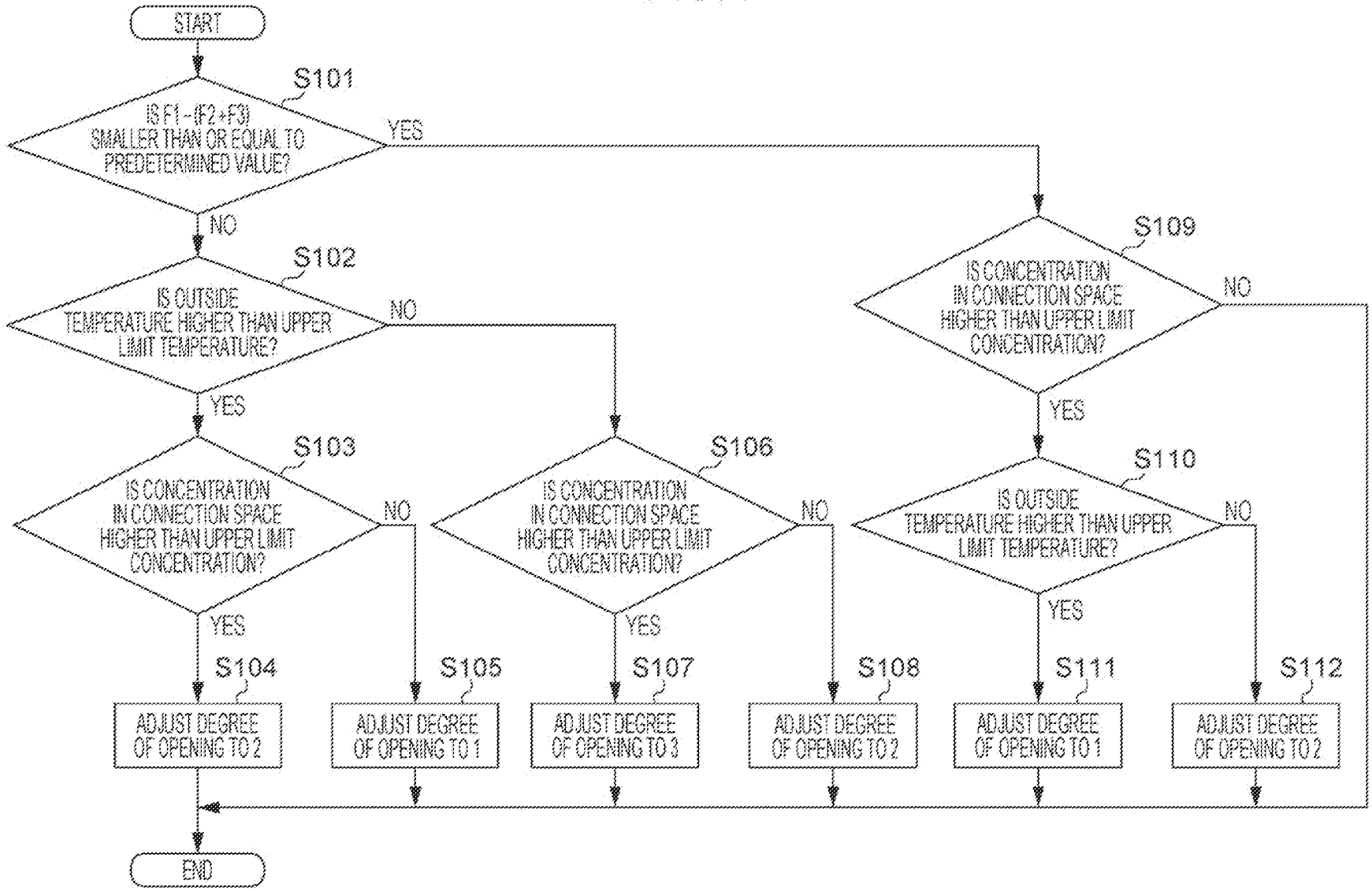
FIG. 7 is a flowchart illustrating a process for controlling a shutter.

FIG. 7 is a flowchart illustrating the process for controlling the shutter 79.

First, the control unit 50 determines whether a difference between the sum of the discharge F2 and the discharge F3 and the supply F1 is smaller than or equal to a predetermined value (S101). The predetermined value may be, for example, a value estimated, through calculation, to cause a difference between the pressure inside the temperature adjustment space S2 and the connection space S4 and the pressure inside the forming device storage space S1. The control unit 50 also obtains, for example, information regarding the supply F1 from the supply detection sensor 70. The control unit 50 also obtains, for example, information regarding the discharge F2 from the first discharge amount detection sensor 74. The control unit 50 also obtains, for example, information regarding the discharge F3 from the second discharge amount detection sensor 78.

If a result of step S101 is negative, the control unit 50 determines whether the temperature of the outside of the image forming apparatus 1 is higher than an upper limit temperature (S102). More specifically, the control unit 50 determines whether a temperature detected by the outside temperature detection sensor 83 is higher than the upper limit temperature. The upper limit temperature, which is an example of a predetermined value, is based on a tolerable temperature of air flowing into the connection space S4 in view of maintaining the temperature of the temperature adjustment space S2 and the connection space S4. The upper limit temperature may be any value, but may be, for example, 40° C.

If the outside temperature of the image forming apparatus 1 is higher than the upper limit temperature (YES in S102), the control unit 50 determines whether the concentration of a toner cloud in air in the connection space S4 in unit volume is higher than an upper limit concentration (S103). More specifically, the control unit 50 determines whether the concentration of a cloud toner in unit volume detected by the cloud concentration detection sensor 81 is higher than the upper limited concentration. The upper limit concentration, which is an example of a predetermined value, is based on a tolerable concentration of a toner cloud in the connection space S4 in unit volume in view of maintaining the accuracy of the operation for forming an image performed by the image forming device 10.

If the concentration of the cloud toner in the connection space S4 in unit volume is higher than the upper limit concentration (YES in S103), the control unit 50 adjusts the degree of opening of the connection space S4 to the outside of the image forming apparatus 1 to "2" (S104). More specifically, the control unit 50 adjusts the amount of movement of the shutter 79 such that the degree of opening of the connection space S4 to the outside of the image forming apparatus 1 becomes "2".

If the concentration of the toner cloud in the connection space S4 in unit volume is lower than or equal to the upper limit concentration (NO in S103), the control unit 50 adjusts the degree of opening of the connection space S4 to the outside of the image forming apparatus 1 to "1" (S105).

If a result of step S102 is negative, on the other hand, the control unit 50 determines whether the concentration of the toner cloud in the air in the connection space S4 in unit volume is higher than the upper limit concentration (S106).

If the concentration of the toner cloud in the connection space S4 in unit volume is higher than the upper limit concentration (YES in S106), the control unit 50 adjusts the degree of opening of the connection space S4 to the outside of the image forming apparatus 1 to "3" (S107). More specifically, the control unit 50 adjusts the amount of movement of the shutter 79 such that the degree of opening of the connection space S4 to the outside of the image forming apparatus 1 becomes "3".

If the concentration of the toner cloud in the connection space S4 in unit volume is lower than or equal to the upper limit concentration (NO in S106), on the other hand, the control unit 50 adjusts the degree of opening of the connection space S4 to the outside of the image forming apparatus 1 to "2" (S108).

If the result of step S101 is positive, the control unit 50 determines whether the concentration of the toner cloud in the air in the connection space S4 in unit volume is higher than the upper limit concentration (S109). If a result of S109 is negative, the process for controlling the shutter 79 ends.

If the concentration of the toner cloud in the connection space S4 in unit volume is higher than the upper limit concentration (YES in S109), on the other hand, the control unit 50 determines whether the temperature of the outside of the image forming apparatus 1 is higher than the upper limit temperature (S110).

If the temperature of the outside of the image forming apparatus 1 is higher than the upper limit temperature (YES in S110), the control unit 50 adjusts the degree of opening of the connection space S4 to the outside of the image forming apparatus 1 to "1" (S111). More specifically, the control unit 50 adjusts the amount of movement of the shutter 79 such that the degree of opening of the connection space S4 to the outside of the image forming apparatus 1 becomes "1".

If the temperature of the outside of the image forming apparatus 1 is lower than or equal to the upper limit temperature (NO in S110), on the other hand, the control unit 50 adjusts the degree of opening of the connection space S4 to the outside of the image forming apparatus 1 to "2" (S112).

As described above, if the temperature of the outside of the connection space S4 is higher than the upper limit temperature, the shutter 79 reduces the area of the opening compared to when the temperature of the outside of the connection space S4 is lower than or equal to the upper limit temperature.

In the present exemplary embodiment, if the concentration of dust in the connection space S4 exceeds the upper limit concentration, the shutter 79 and the external opening area H2 increase the area of the opening provided for the connection space S4. The dust may be, for example, a toner cloud.

Although an exemplary embodiment of the present disclosure has been described, the technical scope of the present disclosure is not limited to the above exemplary embodiment. It is evident from the claims that the technical scope of the present disclosure also includes modes obtained by modifying or improving the above exemplary embodiment in various ways.

Although the connection space S4 and the temperature adjustment space S2 are different spaces in the present exemplary embodiment, the connection space S4 may be the same space as the temperature adjustment space S2, instead. In this case, the connection space S4 is regarded as a temperature adjustment space.

Although opening and closing of the shutter 79 is controlled in step S101 of the process for controlling the shutter 79 on the basis of the supply F1, the discharge F2, and the discharge F3 in the present exemplary embodiment, a method for controlling the opening and closing of the shutter 79 is not limited to this.

For example, a first pressure detection sensor that detects the pressure inside the forming device storage space S1 and a third pressure detection sensor that detects the pressure inside the connection space S4 may be provided, and if a difference between the detected pressure inside the forming device storage space S1 and the detected pressure inside the connection space S4 is smaller than or equal to a predetermined value, the result of step S101 may become positive. If the difference between the detected pressure inside the forming device storage space S1 and the detected pressure inside the connection space S4 is larger than the predetermined value, the result of step S101 may become negative.

Although the connection space S4 opens to the outside of the image forming apparatus 1 even if the temperature of the outside of the image forming apparatus 1 is lower than or equal to the upper limit temperature in step S102 or step S110 of the process for controlling the shutter 79 in the present exemplary embodiment, the connection space S4 need not open to the outside of the image forming apparatus 1 in these cases.

If the temperature of the outside of the image forming apparatus 1 is lower than or equal to the upper limit temperature in step S102 or step S110 of the process for controlling the shutter 79, the connection space S4 may be closed to the outside of the image forming apparatus 1. When the area of the opening in the connection space S4 is reduced, the area of the opening in the connection space S4 may be reduced to 0.

Although the outside of the external opening area H2 of the connection space S4 is the outside of the image forming apparatus 1 in the present exemplary embodiment, the outside of the external opening area H2 of the connection space S4 may be the inside of the image forming apparatus 1, instead, insofar as it is the outside of the connection space S4.

In addition, a supply fan that supplies air outside the connection space S4 into the connection space S4 or a discharge fan that discharges air inside the connection space S4 to the outside of the connection space S4 may also be provided near the shutter 79. If the pressure inside the temperature adjustment space S2 and the connection space S4 is higher than that inside the forming device storage space S1. or that of the outside of the image forming apparatus 1, the shutter 79 may be opened and the discharge fan may be operated to discharge air in the connection space S4 to the outside. In addition, if the pressure inside the temperature adjustment space S2 and the connection space S4 is lower than that inside the forming device storage space S1 or that of the outside of the image forming apparatus 1, for example, the shutter 79 may be opened and the supply fan may be operated to supply air outside the connection space S4 into the connection space S4.

Second Exemplary Embodiment

Next, an image forming apparatus 1 according to a second exemplary embodiment will be described.

In the present exemplary embodiment, a case storing the temperature adjustment space S2 is structured on the basis of a relationship between a portion thereof through which air whose temperature has been adjusted by the temperature adjusting device 61 and that flows toward the temperature adjustment space S2 flows and a portion thereof through which air flows from the temperature adjustment space S2 toward the forming device storage space S1 flows. In addition, the case storing the temperature adjustment space S2 is structured on the basis of a relationship between a portion thereof through which air that flows from the forming device storage space S1 toward the temperature adjustment space S2 flows and a portion thereof through which air that flows from the temperature adjustment space S2 toward the temperature adjusting device 61 flows.

Figure 8:
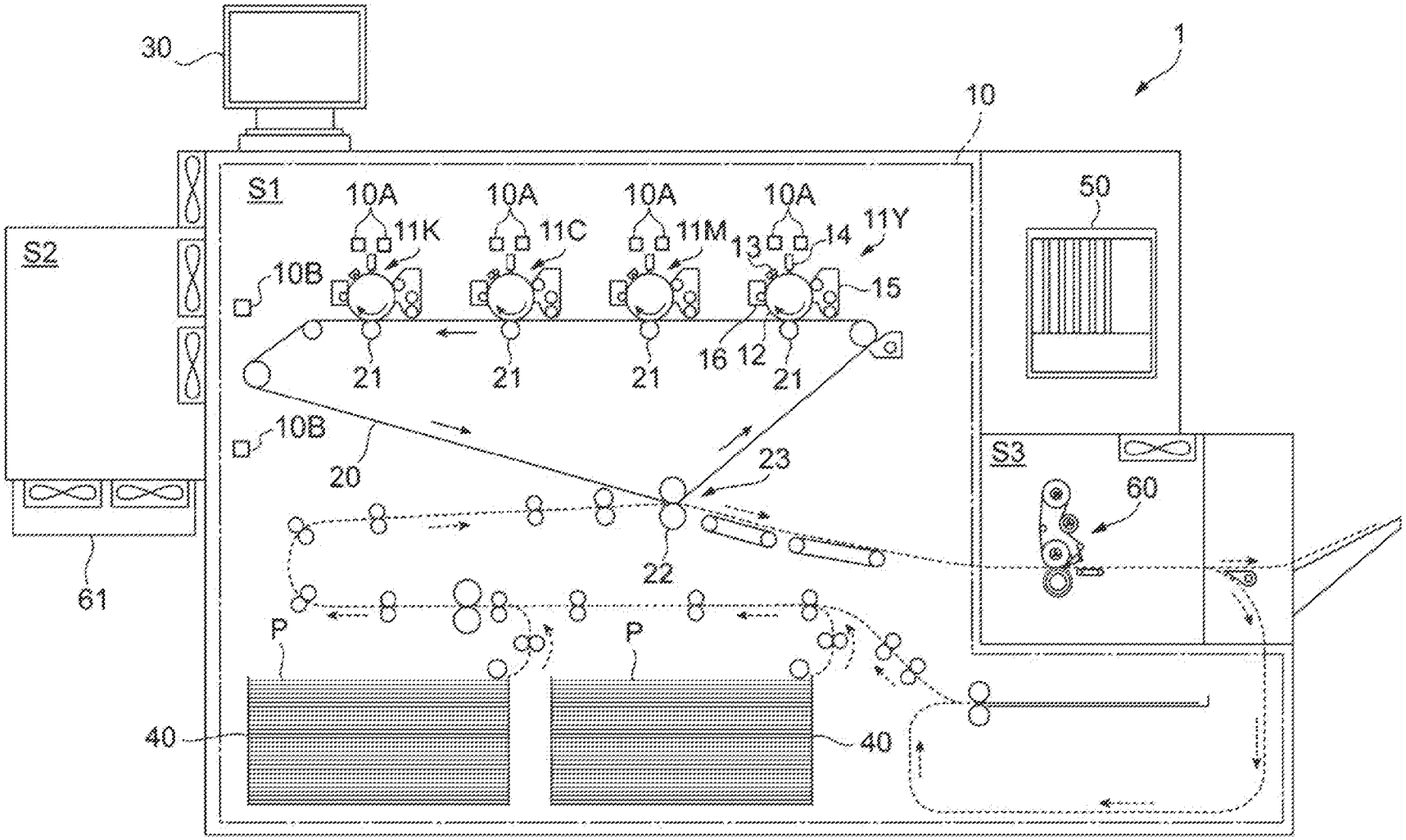
FIG. 8 is a diagram illustrating the configuration of an image forming apparatus according to a second exemplary embodiment.

FIG. 8 is a diagram illustrating the configuration of the image forming apparatus 1 according to the second exemplary embodiment. In the second exemplary embodiment, the same components as in the first exemplary embodiment are given the same reference numerals. In the second exemplary embodiment, description of the same components as in the first exemplary embodiment might be omitted.

The image forming device 10 according to the present exemplary embodiment is provided with four image forming units 11. More specifically, the image forming device 10 is provided with an image forming unit 11Y for yellow (Y), an image forming unit 11M for magenta (M), an image forming unit 11C for cyan (C), and an image forming unit 11K for black (K). The image forming units 11Y, 11M, 11C, and 11K are arranged in this order from upstream in a movement direction of the transfer belt 20.

The image forming apparatus 1 is provided with forming device air discharge areas 10A that discharges air in the forming device storage space S1. In the present exemplary embodiment, eight forming device air discharge areas 10A are provided. More specifically, two forming device air discharge areas 10A are provided for each of the image forming units 11. An opening is formed in each of the forming device air discharge areas 10A, and air in the forming device storage space S1 is discharged through the opening.

Air supply areas 10B that supply air into the forming device storage space S1 are also provided for the image forming apparatus 1. An opening is formed in each of the air supply areas 10B, and air is supplied into the forming device storage space S1. through the opening. In the present exemplary embodiment, two air supply areas 10B are provided in a vertical direction.

Figure 9:
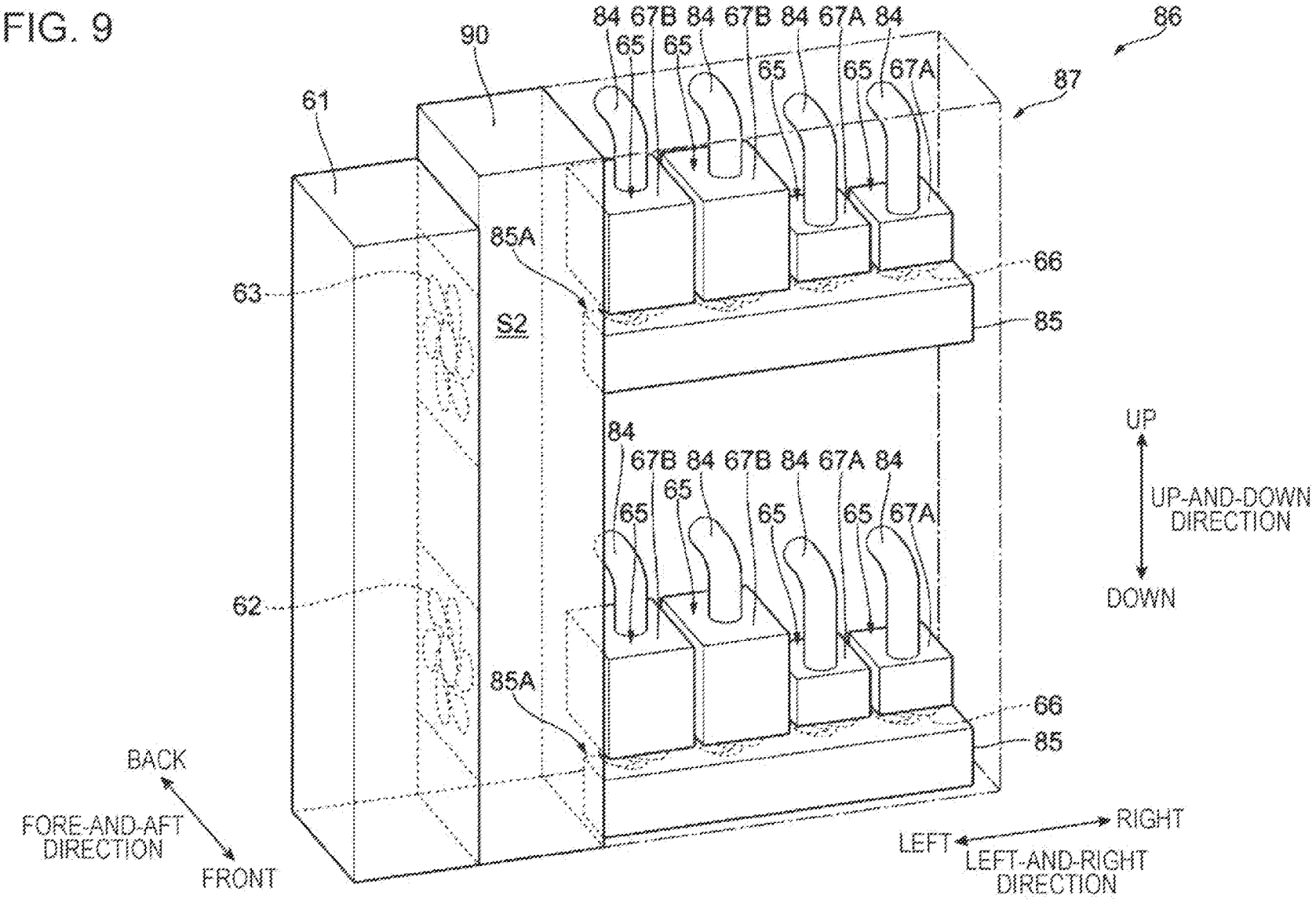
FIG. 9 is a perspective view illustrating the configuration of an air supply and discharge unit.

FIG. 9 is a perspective view illustrating the configuration of an air supply and discharge unit 86. The air supply and discharge unit 86 supplies air into the forming device storage space S1 and discharges air from the forming device storage space S1 . The air supply and discharge unit 86 is provided farther in a depth direction of FIG. 8 than the image forming device 10 of the image forming apparatus 1.

Upward and downward directions of the air supply and discharge unit 36 illustrated in FIG. 9 will be referred to as "up" and "down", respectively, and these directions will be collectively referred to as an "up-and-down direction". Leftward and rightward directions of the air supply and discharge unit 86 illustrated in FIG. 9 will be referred to as "left" and "right", respectively, and these directions will be collectively referred to as a "left-and-right direction". Forward and backward directions of the air supply and discharge unit 86 illustrated in FIG. 9 will be referred to as "front" and "back", respectively, and these directions will be collectively referred to as a "fore-and-aft direction".

The air supply and discharge unit 86 is provided with the temperature adjusting device 61, an adjustment space storage unit 90, and a discharge apparatus 87. In the air supply and discharge unit 86, the temperature adjusting device 61, the adjustment space storage unit 90, and the discharge apparatus 87 are arranged in this order from the left.

The temperature adjusting device 61 extends in the up-and-down direction. In the temperature adjusting device 61, the device air supply fan 62 is provided below the device air discharge fan 63. The device air supply fan 62 supplies air whose temperature has been adjusted by the temperature adjusting device 61 to the right. In other words, the device air supply fan 62 sends air having an adjusted temperature to the adjustment space storage unit 90.

The adjustment space storage unit 90, which is an example of a case, includes the temperature adjustment space S2. The adjustment space storage unit 90 is adjacent to the temperature adjusting device 61. The configuration of the adjustment space storage unit 90 will be described later.

The discharge apparatus 87 discharges air in the forming device storage space S1 to the temperature adjustment space S2. The discharge apparatus 87 is adjacent to the adjustment space storage unit 90. The discharge apparatus 87 is provided with forming device space air discharge devices 65, pipes 84, and guiding units 85.

The pipes 84 have tubular shapes. Eight pipes 84 are provided for the discharge apparatus 87. In other words, pipes 84 as many as the forming device air discharge areas 10A (refer to FIG. 8) are provided in the present exemplary embodiment. An end of the each of the pipes 84 is connected to a corresponding one of the forming device air discharge areas 10A.

In the present exemplary embodiment, eight forming device space air discharge devices 65 are provided. Four of the eight forming device space air discharge devices 65 are each provided with a forming device space air discharge fan 66 and an ozone filter 67A. The other four forming device space air discharge devices 65 are each provided with a forming device space air discharge fan 66 and a dust filter 67B.

The ozone filter 67A is connected to an end of a corresponding one of the pipes 84 opposite an end connected to a corresponding one of the forming device air discharge areas 10A. The ozone filter 67A collects ozone in air sent from the forming device storage space S1 through the corresponding pipe 84.

The dust filter 67B is connected to an end of a corresponding one of the pipes 84 opposite an end connected to a corresponding one of the forming device air discharge areas 10A. The dust filter 67B collects dust in air sent from the forming device storage space S1. through the corresponding pipe 84.

One of the forming device space air discharge devices 65 provided with the ozone filters 67A and one of the forming device space air discharge devices 65 provided with the dust filters G7B are connected, through corresponding pipes 84, to the two forming device air discharge areas 10A, respectively, provided for each of the image forming units 11.

In the present exemplary embodiment, two sets of forming device space air discharge devices 65 are provided in the up-and-down direction, and four forming device space air discharge devices 65 are arranged next to each other in the left-and-right direction in each of the sets. In each set of the forming device space air discharge devices 65, two forming device space air discharge devices 65 provided with the ozone filters 67A and two forming device space air discharge devices 65 provided with the dust filters 67B are arranged in this order from the right.

The guiding units 85 guide air sent to the forming device space air discharge devices 65. The guiding units 85 have a shape of a rectangular parallelepiped and extend in the left-and-right direction. The guiding units 85 are hollow and each include an opening area 85A including an opening. The opening in the opening area 85A is connected to a hollow in the guiding unit 85. Two guiding units 85 are provided in the up-and-down direction. Each of the guiding units 85 is connected to the four forming device space air discharge devices 65 arranged in the left-and-right direction.

In the present exemplary embodiment, when the forming device space air discharge fans 66 operate, air in the forming device storage space S1 (refer to FIG. 8) is sent into the discharge apparatus 87 through the forming device air discharge areas 10A. The air sent into the discharge apparatus 87 is then sent to the guiding units 85 through the pipes 84 and the ozone filters 67A or the dust filters 67B. The air sent to the guiding units 85 is guided to the left. In other words, the air sent to the guiding units 85 is guided to the adjustment space storage unit 90.

Next, the configuration of the adjustment space storage unit 90 will be described.

Figure 10:
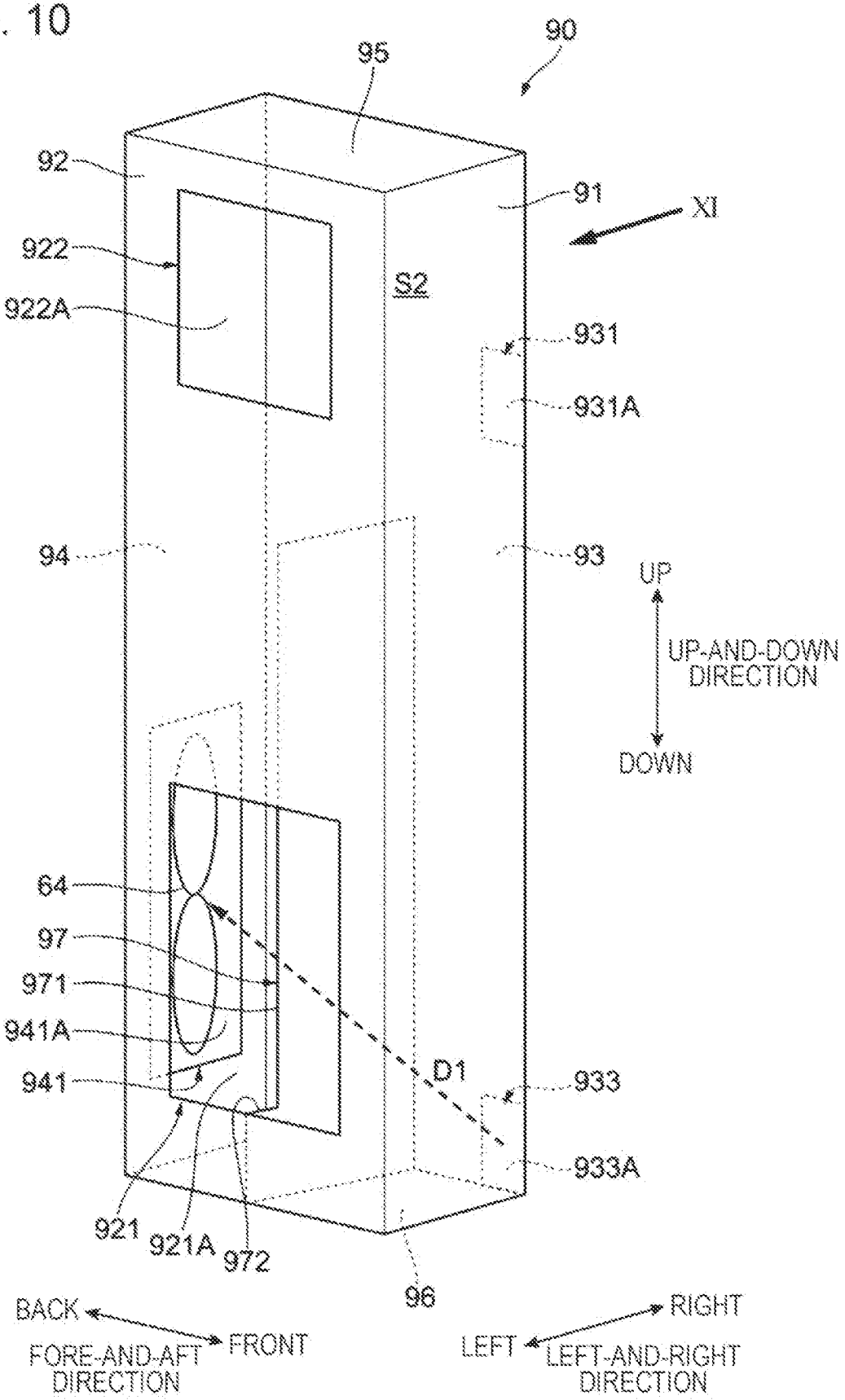
FIG. 10 is a perspective view of an adjustment space storage unit.

FIG. 10 is a perspective view of the adjustment space storage unit 90.

Figure 11:
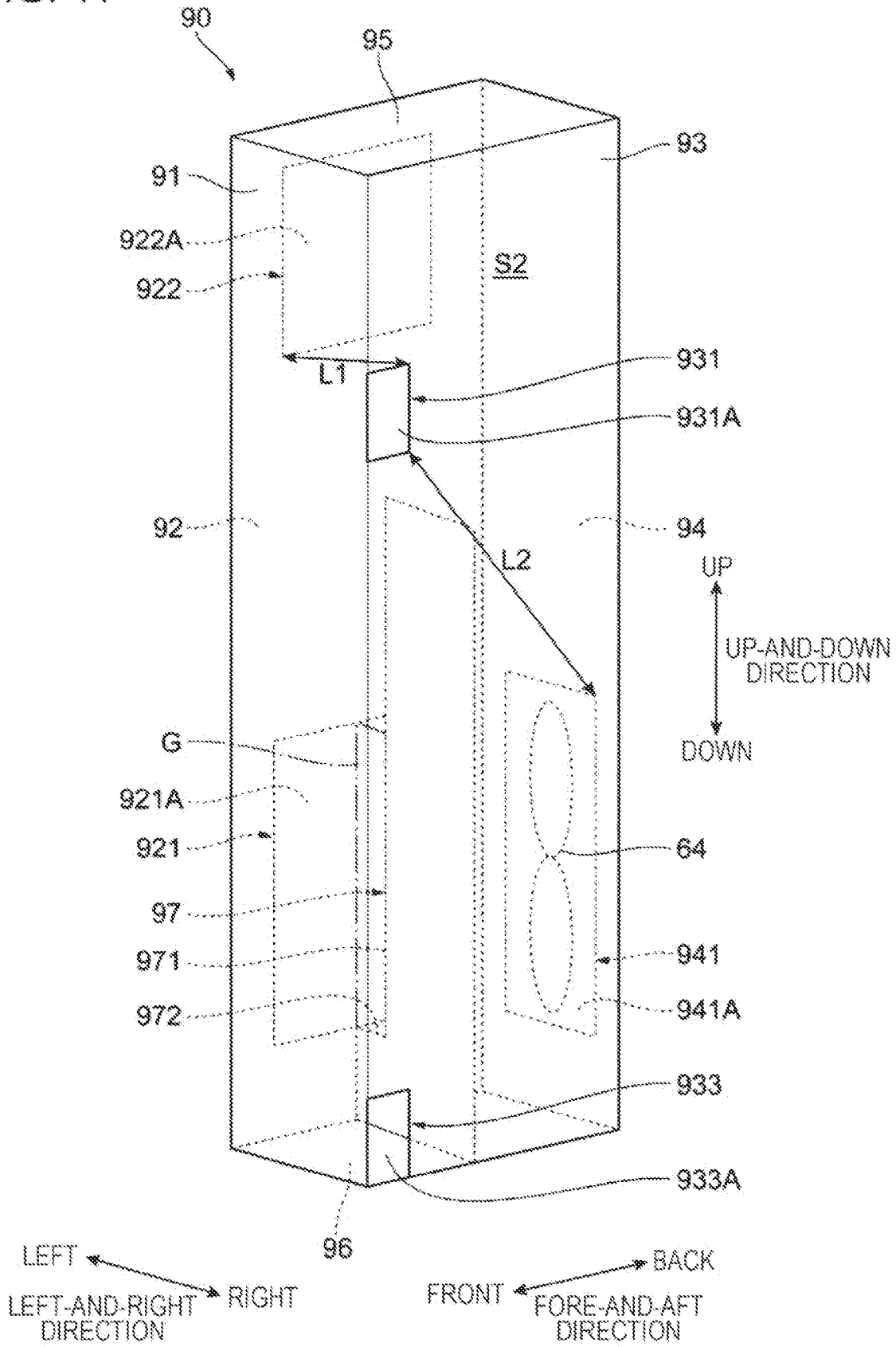
FIG. 11 is a diagram illustrating the adjustment space storage unit viewed from an X1, direction in FIG. 10.

FIG. 11 is a diagram illustrating the adjustment space storage unit 90 viewed from an X1 direction in FIG. 10.

Figure 12:
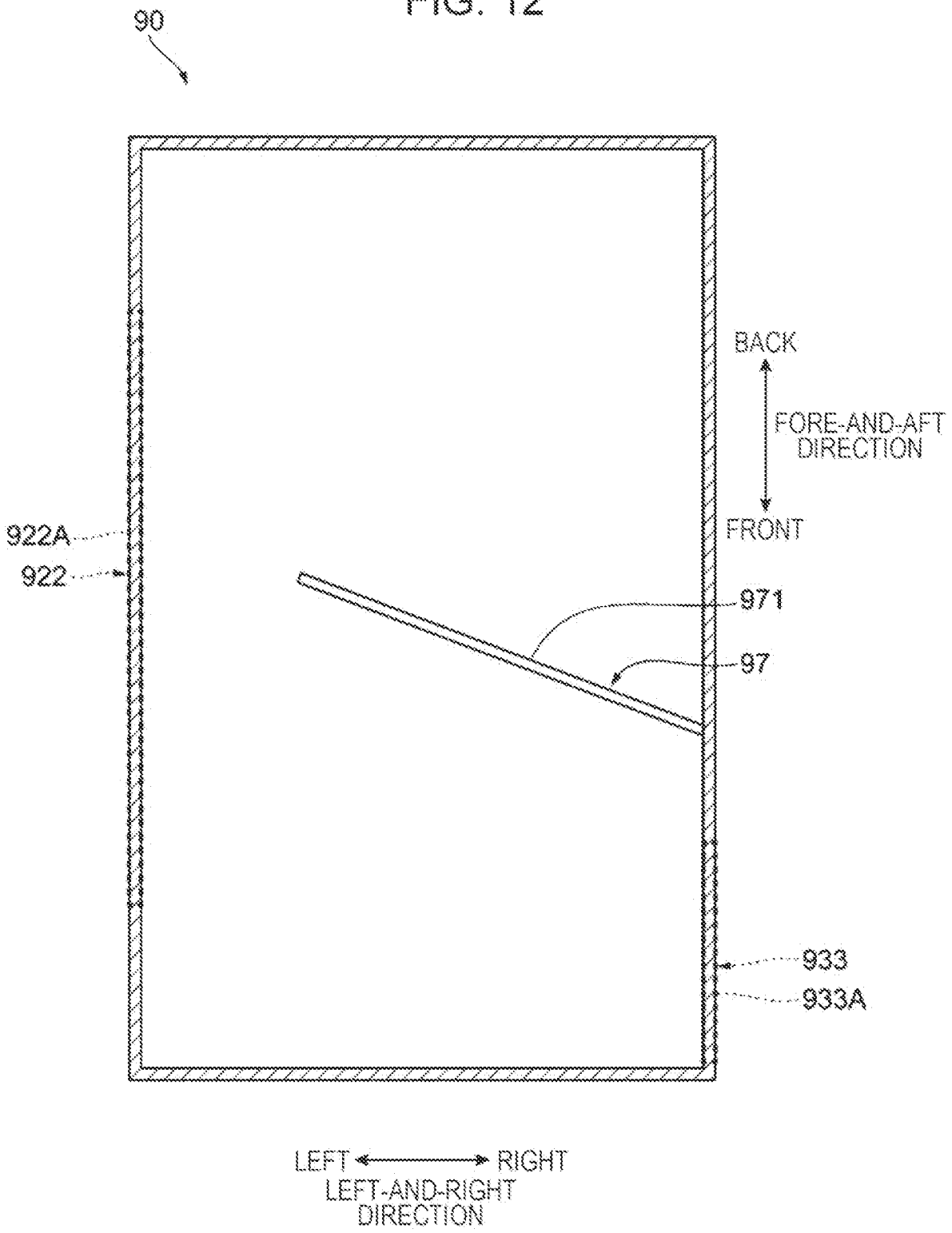
FIG. 12 is a cross-sectional view of the adjustment space storage unit viewed from above.

FIG. 12 is a cross-sectional view of the adjustment space storage unit 90 viewed from above.

The adjustment space storage unit 90 has a shape of a rectangular parallelepiped and extends in the up-and-down direction. The adjustment space storage unit 90 is hollow and includes the temperature adjustment space S2.

The adjustment space storage unit 90 includes a front surface 91 provided on a front side, a left surface 92 provided on a left side, a right surface 93 provided on a right side, a back surface 94 provided on a back side, a top surface 95 provided on an upside, and a bottom surface 96 provided on a downside. The adjustment space storage unit 90 is provided with the adjustment space air supply fan 64. A temperature sensor that detects the temperature of air sent to the adjustment space air supply fan 64 may also be provided.

The left surface 92 is provided with a lower opening area 921 and an upper opening area 922. The lower opening area 921 and the upper opening area 922 of the left surface 92 are arranged in the up-and-down direction. The lower opening area 921 is provided below the upper opening area 922.

The lower opening area 921 of the left surface 92 is arranged next to the device air supply fan 62 of the temperature adjusting device 61 (refer to FIG. 9) in the left-and-right direction. An opening 921A is formed in the lower opening area 921. The opening 921A in the lower opening area 921 faces to the right. Air sent from the device air supply fan 62 of the temperature adjusting device 61 flows into the temperature adjustment space S2 through the opening 921A in the lower opening area 921.The opening 921A, therefore, is regarded as an intake.

The upper opening area 922 of the left surface 92 is arranged next to the device air discharge fan 63 of the temperature adjusting device 61 in the left-and-right direction. An opening 922A is formed in the upper opening area 922.

When the device air discharge fan 63 operates, air in the temperature adjustment space S2 is taken into the temperature adjusting device 61 through the opening 922A in the upper opening area 922. The opening 922A, therefore, is regarded as an outlet.

The right surface 93 of the adjustment space storage unit 90 is provided with an upper opening area 931 and a lower opening area 933. The upper opening area 931 and the lower opening area 933 of the right surface 93 are arranged in the up-and-down direction. In the right surface 93, the upper opening area 931 and the lower opening area 933 are arranged in this order from the top.

An opening 931A is formed in the upper opening area 931 of the right surface 93. The opening area 85A of an upper one of the two guiding units 85 provided for the discharge apparatus 87 (refer to FIG. 9) is connected to the upper opening area 931. Air sent from the forming device storage space S1 to the upper guiding unit 85 flows into the temperature adjustment space S2 through the opening 931A in the upper opening area 931. The opening 931A in the upper opening area 931, therefore, is taken as an intake.

An opening 933A is formed in the lower opening area 933 of the right surface 93. The opening area 85A of a lower one of the two guiding units 85 provided for the discharge apparatus 87 is connected to the lower opening area 933 . Air sent from the forming device storage space S1 to the lower guiding unit 85 flows into the temperature adjustment space S2 through the opening 933A in the lower opening area 933.

The opening 931A in the upper opening area 931 and the opening 933A in the lower opening area 933 both face to the left.

Temperature sensors (not illustrated) that detect temperature may be provided near the upper opening area 931 and the lower opening area 933 of the right surface 93. The temperature sensors detect temperature of air that has flowed into the temperature adjustment space S2 from the forming device storage space S1 through the upper opening area 931 and the lower opening area 933, respectively. The temperature adjusting device 61 may then be controlled such that a target temperature is set in accordance with the temperatures detected by the temperature sensors and the temperaturesdetected by the temperature sensors fall within a predetermined range.

An opening area 941 is provided for the back surface 94 of the adjustment space storage unit 90. An opening 941A. is formed in the opening area 941. A position of a part of the opening 941A in the opening area 941 is aligned with a position of the opening 921A in the lower opening area 921 of the leftt surface 92 in the up-and-down direction.

The opening area 941 of the back surface 94 is connected to the two air supply areas 10B (refer to FIG. 8) of the image forming apparatus 1 through pipes (not illustrated). When the adjustment space air supply fan 64 operates, air in the temperature adjustment space S2 flows into the forming device storage space S1 through the opening 941A in the opening area 941 of the back surface 94 and the openings in the air supply areas 10B. The opening 941A in the opening area 941, therefore, is regarded as an outlet.

In the present exemplary embodiment, a length from the opening 931A in the upper opening area 931 of the right surface 93 to the opening 922A in the upper opening area 922 of the left surface 92 is a length L1 (refer to FIG. 11). A length from the opening 931A in the upper opening area 931 of the right surface 93 to the opening 941A in the opening area 941 of the back surface 94 is a length L2. The length L1 is smaller than the length L2.

The adjustment space storage unit 90 is also provided with a separation member 97 that separates the lower opening area 933 of the right surface 93 and the opening area 941 of the back surface 94 from each other.

The separation member 97, which is an example of a wall member, is provided between the upper opening area 931 and the lower opening area 933 of the right surface 93 and the opening area 941 of the back surface 94 in the fore-and-aft direction. The separation member 97 includes a separation part 971 and an extending part 972.

The separation part 971 extends in the up-and-down direction and the left-and-right direction. The separation part 971 has a shape of a plate. A surface of the separation part 971 faces to the front, and another surface of the separation part 971 faces to the back.

The separation part 971 is provided below the upper opening area 931 of the right surface 93.

The separation part 971 extends from below the lower opening area 921 of the left surface 92 to above the lower opening area 921.

The separation part 971 extends from below the opening area 941 of the back surface 94 to above the opening area 941.

A lower edge of the separation part 971 is in contact with the bottom surface 96 of the adjustment space storage unit 90. A right edge of the separation part 971 is in contact with the right surface 93 of the adjustment space storage unit 90. A left edge of the separation part 971, on the other hand, is not in contact with the left surface 92 of the adjustment space storage unit 90, and there is a gap G (refer to FIG. 11) between the separation part 971 and the lower opening area 921. of the left surface 92.

The separation part 971 is slanted in the left-and-right direction. More specifically, the separation part 971 is gradually slanted to the back toward the left edge thereof.

The extending part 972 is provided at a lower end of the separation member 97. In other words, the extending part 972 is provided below the opening 921A in the lower opening area 921 of the left surface 92 of the adjustment space storage unit 90. The extending part 972 extends from the left edge of the separation part 971 farther to the left. A left edge of the extending part 972 is in contact with the left surface 92 of the adjustment space storage unit 90. An area of the temperature adjustment space S2 under the lower opening area 921. of the left surface 92, therefore, is divided into an area in front of the separation member 97 and an area behind the separation member 97.

In the present exemplary embodiment, air whose temperature has been adjusted by the temperature adjusting device 61. flows into the temperature adjustment space S2 through the opening 921A in the lower opening area 921 of the left surface 92 of the adjustment space storage unit 90. The air that has flowed into the temperature adjustment space S2 then flows into the forming device storage space S1 through the opening 941A in the opening area 941 of the back surface 94. The position of a part of the opening 941A in the opening area 941 of the back surface 94 is aligned with the position of the opening 921A in the lower opening area 921 of the left surface 92. In other words, the position of a part of the opening 941A in the opening area 941 of the back surface 94 is aligned with the position of the opening 921A in the lower opening area 921 of the left surface 92 in a direction intersecting with a direction in which the opening 921A in the lower opening area 921 of the left surface 92 faces.

Air in the forming device storage space S1 flows into the temperature adjustment space S2 through the forming device air discharge areas 10A, the discharge apparatus 87, and the opening 931A in the upper opening area 931 of the right surface 93 of the adjustment space storage unit 90. The air that has flowed into the temperature adjustment space S2 then flows toward the temperature adjusting device 61 through the opening 922A in the upper opening area 922 of the left surface 92 of the adjustment space storage unit 90. The length L1 from the opening 931A in the upper opening area 931 of the right surface 93 to the opening 922A in the upper opening area 922 of the left surface 92 is smaller than the length L2 from the opening 931A in the upper opening area 931 of the right surface 93 to the opening 941A in the opening area 941 of the back surface 94.

The opening 922A in the upper opening area 922 of the left surface 92 of the adjustment space storage unit 90 is located to the left of the opening 931A in the upper opening area 931 of the right surface 93. In other words, the opening 922A in the upper opening area 922 of the left surface 92 is located downstream of the opening 931A in a direction in which the opening 931A in the upper opening area 931 of the right surface 93 faces.

A suppression unit is provided between the opening 933A in the lower opening area 933 of the right surface 93 of the adjustment space storage unit 90 and the opening 941A in the opening area 941 of the back surface 94. The suppression unit suppresses a flow of air supplied into the temperature adjustment space S2 through the opening 933A in the lower opening area 933 of the right surface 93 toward the opening 941A in the opening area 941 of the back surface 94. In the present exemplary embodiment, the suppression unit is specifically the separation member 97 extending in the left-and-right direction. In other words, the separation member 97 extends in a direction intersecting with a flowing direction D1 (refer to FIG. 10) from the opening 933A in the lower opening area 933 of the right surface 93 to the opening 941A in the opening area 941 of the back surface 94.

It is possible that a flow of air supplied from the forming device storage space S1 into the temperature adjustment space S2 toward the opening 941A in the opening area 941 of the back surface 94 is suppressed with a configuration different from that in the present exemplary embodiment. In an example, the lower opening area 921. of the left surface 92 and the opening area 941 of the back surface 94 might be included in a space separated from another space including the upper opening area 931 and the lower opening area 933 of the right surface 93 and the upper opening area 922 of the left surface 92. With this configuration, however, if the amount of air flowing between the temperature adjustment space S2 and the forming device storage space S1 in unit time and the amount of air flowing between the temperature adjustment space S2 and the temperature adjusting device 61 in unit time are different from each other, pressure inside each of the separated spaces tends to change. In this case, the amount of air flowing into and out of each of the separated spaces also tends to change.

In the present exemplary embodiment, on the other hand, the separation member 97 suppresses a flow of air supplied from the forming device storage space S1 into the temperature adjustment space S2 toward the opening 941A in the opening area 941 of the back surface 94. In other words, a flow of air supplied from the forming device storage space S1 into the temperature adjustment space S2 toward the opening 941A in the opening area 941 of the back surface 94 is suppressed without dividing the temperature adjustment space S2 into different spaces.

In addition, the opening 921A in the lower opening area 921 of the left surface 92 of the adjustment space storage unit 90 is formed from upstream of the separation member 97 to downstream of the separation member 97 in the flowing direction D1. With this configuration, part of air sent to the device air supply fan 62 flows into the area of the temperature adjustment space S2 in front of the separation member 97. In this case, air that has flowed into the temperature adjustment space S2 from the forming device storage space S1 through the opening 933A in the lower opening area 933 of the right surface 93 tends to flow upward along the separation member 97 due to air sent by the device air supply fan 62 to the area in front of the separation member 97. The air that has flowed upward is then taken by the device air discharge fan 63 (refer FIG. 9) into the temperature adjusting device 61 through the opening 922A in the upper opening area 922 of the left surface 92.

In addition, the separation part 971 of the separation member 97 is slanted to the back toward the left edge thereof. In other words, the separation part 971 includes a first wall and a second wall, which is provided to the left and the back of the first wall. The first wall is, for example, a part of the separation part 971 to the right of the center of the separation part 971 in the left-and-right direction. The second wall is a part of the separation part 971 to the left of the center of the separation part 971 in the left-and-right direction. In this case, air that has flowed into the temperature adjustment space S2 through the opening 933A in the lower opening area 933 of the right surface 93 tends to flow leftward and backward along the separation part 971. In other words, the air that has flowed into the temperature adjustment space S2 tends to flow toward the opening 922A in the upper opening area 922 of the left surface 92.

The position of a part of the opening 941A in the opening area 941 of the back surface 94 of the adjustment space storage unit 90 is aligned with the position of the opening 921A in the lower opening area 921 of the left surface 92 in the up-and-down direction in the present exemplary embodiment, the arrangement of the opening 941A is not limited to this. For example, the opening 941A may be provided in the right surface 93 at a position aligned with the opening 921A in the lower opening area 921 of the left surface 92 in the up-and-down direction, instead. Alternatively, for example, the opening 941A may be provided in the bottom surface 96 at a position aligned with the opening 921A in the lower opening area 921 of the left surface 92 in the fore-and-aft direction. That is, the opening 941A may be provided at a position aligned with the opening 921A in the lower opening area 921 of the left which the opening 921A in the lower opening area 921 of the left surface 92 faces.

In addition, although the opening 922A in the upper opening area 922 is provided in the left surface 92 in the present exemplary embodiment, the arrangement of the opening 922A is not limited to this. For example, the opening 922A may be provided in the front surface 91, instead. That is, it is only required that the opening 922A be located downstream of the opening 931A in the direction in which the opening 931A in the upper opening area 931 of the right surface 93 faces.

In addition, although the separation member 97 is used as the suppression unit that suppresses a flow of air supplied from the forming device storage space S1 into the temperature adjustment space S2 toward the opening 941A in the opening area 941 of the back surface 94 in the present exemplary embodiment, the suppression unit is not limited to this.

For example, a blower (not illustrated) may be provided between the opening 933A in the lower opening area 933 of the right surface 93 of the adjustment space storage unit 90 and the opening 941A in the opening area 941 of the back surface 94 as the suppression unit, instead. The blower may be arranged in such a way as to send air to the front. In this case, too, air that has flowed into the temperature adjustment space opening 933A in the lower adjustment space S2 through the opening lower opening area 933 of the right surface 93 hardly flows toward the opening 941A in the opening area 941 of the back surface 94 due to the air sent from the blower.

In addition, not all the air sent from the forming device storage space S1 to the discharge apparatus 87 needs to flow into the temperature adjustment space S2. If the amount of air sent from the forming device storage space S1 to the discharge apparatus 87 in unit time is larger than the amount of air sent from the temperature adjustment space S2 to the forming device storage space S1 in unit time, part of the air sent to the discharge apparatus 87 may be discharged to the outside of the image forming apparatus 1. If the amount of air sent from the forming device storage space S1 to the discharge apparatus 87 in unit time is smaller than the amount of air sent from the temperature adjustment space S2 to the forming device storage space S1 in unit time, air may be sent to the discharge apparatus 87 from the outside of the image forming apparatus 1.

The present disclosure is based on Japanese Patent Application No. 2019-214277 filed in the Japan Patent Office on Nov. 27, 2019 and Japanese Patent Application No. 2020-057008 filed in the Japan Patent Office on Mar. 27, 2020, the entire contents of which are incorporated herein by reference.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image forming device that forms an image on a recording material;

a forming device storage space storing the image forming device;

a temperature adjustment space where a temperature adjustment device adjusts temperature; and a supply unit that supplies air in the temperature adjustment space into the forming device storage space, wherein the supply unit supplies the air in the temperature adjustment space into the forming device storage space using a first blower, the temperature adjustment device is provided with a second blower that sends air having an adjusted temperature to the temperature adjustment space, and the first blower is different from the second blower.

2. The image forming apparatus according to claim 1, further comprising:

a supply unit that supplies air in the forming device storage space into the temperature adjustment space.

3. The image forming apparatus according to claim 2, further comprising:

a case that includes the temperature adjustment space and in which an intake through which the air whose temperature has been adjusted by the temperature adjustment device and that flows toward the temperature adjustment space flows and an outlet through which the air flowing from the temperature adjustment space toward the forming device storage space flows are formed, wherein a position of at least a part of the outlet is aligned with a position of the intake in a direction intersecting with a direction in which the intake faces.

4. The image forming apparatus according to claim 2, further comprising:

a case that includes the temperature adjustment space and in which a first outlet through which the air flowing from the temperature adjustment space toward the forming device storage space flows, a second outlet through which the air flowing from the temperature adjustment space toward the temperature adjustment device flows, and an intake through which the air flowing from the forming device storage space toward the temperature adjustment space flows are formed, wherein a distance from the intake to the second outlet is smaller than a distance from the intake to the first outlet.

5. The image forming apparatus according to claim 4, wherein the temperature adjustment device is provided with a blower that sends the air in the temperature adjustment space to the temperature adjustment device through the second outlet, and wherein the second outlet is located downstream of the intake in a direction in which the intake faces.

6. The image forming apparatus according to claim 2, further comprising:

a case that includes the temperature adjustment space and in which a first opening through which the air flowing from the forming device storage space toward the temperature adjustment space flows and a second opening through which the air flowing from the temperature adjustment space toward the forming device storage space flows are formed; and a suppression unit that is provided between the first opening and the second opening and that suppresses a flow of air supplied into the temperature adjustment space through the first opening toward the second opening.

7. The image forming apparatus according to claim 6, wherein the suppression unit is a wall member extending in an intersecting direction intersecting with a flowing direction from the first opening to the second opening.

8. The image forming apparatus according to claim 7, wherein an intake through which the air whose temperature has been adjusted by the temperature adjustment device and that flows toward the temperature adjustment space flows is formed in the case, wherein a blower that sends air having an adjusted temperature to the temperature adjustment space through the intake is provided for the temperature adjustment device, wherein the wall member faces the intake with a gap provided between the wall member and the intake, and wherein the intake extends from upstream of the wall member to downstream of the wall member in the flowing direction.

9. The image forming apparatus according to claim 7, wherein an outlet that is located downstream of the first opening in the flowing direction and through which the air flowing from the temperature adjustment space toward the temperature adjustment device flows is formed in the case, and wherein the wall member includes a first wall and a second wall, which is provided downstream of the first wall in the intersecting direction and downstream of the first wall in the flowing direction.

10. The image forming apparatus according to claim 1, further comprising:

a fixing unit that fixes, on the recording material, the image formed by the image forming device on the recording material;

a fixing unit storage space that is connected to the forming device storage space and that stores the fixing unit; and a pressurization unit that makes pressure inside the forming device storage space higher than pressure inside the fixing unit storage space.

11. The image forming apparatus according to claim 10, wherein the pressurization unit makes the pressure inside the forming device storage space higher than the pressure inside the fixing unit storage space by supplying air outside the image forming apparatus into the forming device storage space.

12. The image forming apparatus according to claim 1, further comprising:

an outside air supply unit that supplies air outside the image forming apparatus into the forming device storage space.

13. The image forming apparatus according to claim 1, further comprising:

a fixing unit that fixes, on the recording material, the image formed by the image forming device on the recording material;

a fixing unit storage space storing the fixing unit; and a channel that allows air in the temperature adjustment space or a connection space connected to the temperature adjustment space to flow toward the fixing unit storage space.

14. The image forming apparatus according to claim 1, further comprising:

a pressure adjustment unit that adjusts pressure inside the temperature adjustment space.

15. The image forming apparatus according to claim 14, wherein the pressure adjustment unit adjusts the pressure inside the temperature adjustment space by adjusting an area of an opening provided for the temperature adjustment space or a connection space connected to the temperature adjustment space.

16. The image forming apparatus according to claim 15, wherein, if temperature outside the space for which the opening is provided is higher than a predetermined value, the pressure adjustment unit reduces the area of the opening compared to when the temperature is lower than the predetermined value.

17. The image forming apparatus according to claim 1, further comprising:

an opening area adjustment unit that, if concentration of dust in the temperature adjustment space or a connection space connected to the temperature adjustment space exceeds a predetermined value, increases area of an opening provided for the temperature adjustment space or the connection space.

18. An image forming apparatus comprising:

image forming means for forming an image on a recording material;

forming means storage means for storing the image forming means;

temperature adjustment space where a temperature adjustment means adjusts temperature; and supply means for supplying air in the temperature adjustment means into the forming means storage means, wherein the supply means supplies the air in the temperature adjustment space into the forming means storage means using a first blower, the temperature adjustment means is provided with a second blower that sends air having an adjusted temperature to the temperature adjustment space, and the first blower is different from the second blower.

* * * * *